US010759171B2

(12) United States Patent
Tachibana et al.

(10) Patent No.: US 10,759,171 B2
(45) Date of Patent: Sep. 1, 2020

(54) LIQUID DISCHARGE APPARATUS

(71) Applicant: Ricoh Company, Ltd., Tokyo (JP)

(72) Inventors: Eiji Tachibana, Kanagawa (JP); Tadayasu Enomoto, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/266,134

(22) Filed: Feb. 4, 2019

(65) Prior Publication Data

US 2019/0240981 A1 Aug. 8, 2019

(30) Foreign Application Priority Data

Feb. 8, 2018 (JP) ..... 2018-020771
Feb. 8, 2018 (JP) ..... 2018-020783
Nov. 2, 2018 (JP) ..... 2018-207390

(51) Int. Cl.
*B41J 2/165* (2006.01)
*B41J 2/17* (2006.01)
*B41J 2/185* (2006.01)

(52) U.S. Cl.
CPC ..... *B41J 2/1652* (2013.01); *B41J 2/16517* (2013.01); *B41J 2/1714* (2013.01); *B41J 2/185* (2013.01)

(58) Field of Classification Search
CPC .... B41J 2/1652; B41J 2/16517; B41J 2/1714; B41J 2/185; B41J 2002/16555
See application file for complete search history.

(56) References Cited

U.S. PATENT DOCUMENTS 6,464,328 B1 * 10/2002 Hiramatsu ..... B41J 2/1714 347/34
8,690,290 B2 * 4/2014 Masuda ..... B41J 11/002 347/30
9,193,152 B2 * 11/2015 Miller ..... B41J 2/01
2011/0227999 A1 9/2011 Tachibana
2012/0212543 A1 8/2012 Tachibana

FOREIGN PATENT DOCUMENTS

JP 2010-208098 9/2010
JP 2010-214864 9/2010
JP 2011-189702 9/2011
JP 2013-123826 6/2013
JP 2013-237172 11/2013
JP 2015-116828 6/2015
JP 2015-214164 12/2015
JP 2017-209873 11/2017
JP 2017-223916 12/2017

* cited by examiner

*Primary Examiner* — Thinh H Nguyen
(74) *Attorney, Agent, or Firm* — Xsensus LLP

(57) ABSTRACT

A liquid discharge apparatus includes an apparatus body, a holder, a stage, an exhaust fan, a suction port, and a partition. The holder holds a target object. The stage reciprocates while holding the holder that holds the target object. The exhaust fan generates an airflow. The suction port is disposed on a side portion of the holder to suck the airflow generated by the exhaust fan. The partition partitions an interior of the apparatus body into a space including the suction port and a space not including the suction port. The partition and the holder are arranged to form an airflow path toward the suction port between the partition and the holder.

20 Claims, 27 Drawing Sheets

LIQUID DISCHARGE APPARATUS

CROSS-REFERENCE TO RELATED APPLICATIONS

This patent application is based on and claims priority pursuant to 35 U.S.C. § 119(a) to Japanese Patent Application No. 2018-020771, filed on Feb. 8, 2018, No. 2018-020783, filed on Feb. 8, 2018, and No. 2018-207390, filed on Nov. 2, 2018, in the Japan Patent Office, the entire disclosure of which is incorporated by reference herein.

BACKGROUND

Technical Field

Aspects of the present disclosure relates to a liquid discharge apparatus.

Related Art

A liquid discharge apparatus such as a printing apparatus including a liquid discharge head that discharges a liquid performs collection of mist resulted from liquid discharge by using a filter or the like.

SUMMARY

In an aspect of the present disclosure, there is provided a liquid discharge apparatus that includes an apparatus body, a holder, a stage, an exhaust fan, a suction port, and a partition. The holder holds a target object. The stage reciprocates while holding the holder that holds the target object. The exhaust fan generates an airflow. The suction port is disposed on a side portion of the holder to suck the airflow generated by the exhaust fan. The partition partitions an interior of the apparatus body into a space including the suction port and a space not including the suction port. The partition and the holder are arranged to form an airflow path toward the suction port between the partition and the holder.

In another aspect of the present disclosure, there is provided a liquid discharge apparatus that includes an apparatus body, a holder, a stage, an exhaust fan, a suction port, a liquid discharge head, a carriage, and a gap forming member. The holder holds a target object. The stage reciprocates while holding the holder that holds the target object. The exhaust fan generates an airflow. The suction port is disposed on a side portion of the holder to suck the airflow generated by the exhaust fan. The liquid discharge head discharges a liquid onto the target object. The carriage holds the liquid discharge head. The gap forming member forms a spatial gap between the holder and the gap forming member. A lower surface of the gap forming member is arranged at a position higher than a nozzle surface of the liquid discharge head.

In still another aspect of the present disclosure, there is provided a mist collection device that includes an exhaust fan and a plurality of opening members. The exhaust fan generates an airflow. The plurality of opening members is arranged on a downstream side of the exhaust fan in a direction of the airflow generated by the exhaust fan. Each of the plurality of opening members includes an opening portion and a wall portion. At least a part of the opening portion of one opening member on an upstream side in the direction of the airflow out of adjacent two of the plurality of opening members is opposed to at least a part of the wall portion of another opening member on the downstream side in the direction of the airflow out of the adjacent two of the plurality of opening members.

In still yet another aspect of the present disclosure, there is provided a liquid discharge apparatus that includes a liquid discharge device to discharge a liquid and the mist collection device.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
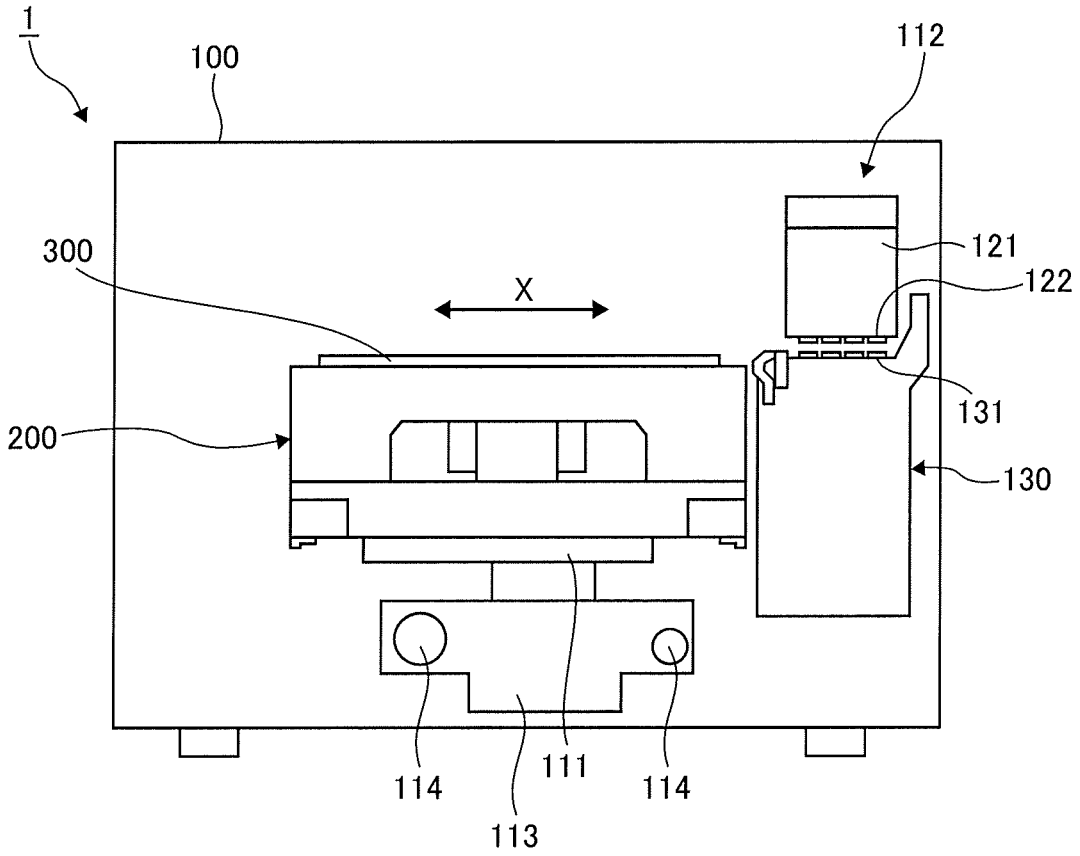
FIG. 1 is a front view of a printing apparatus as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Figure 2:
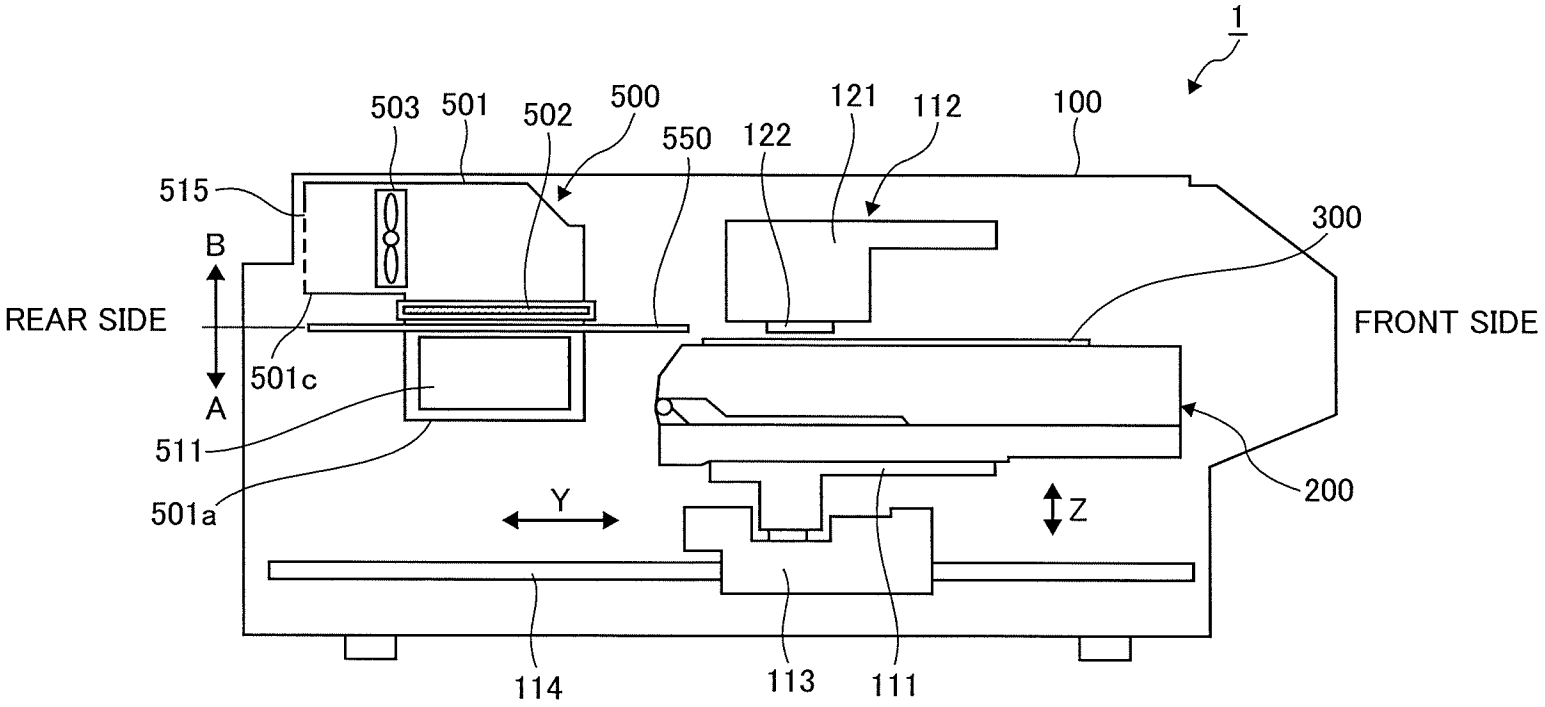
FIG. 2 is a side view of the printing apparatus.
Figure 3:
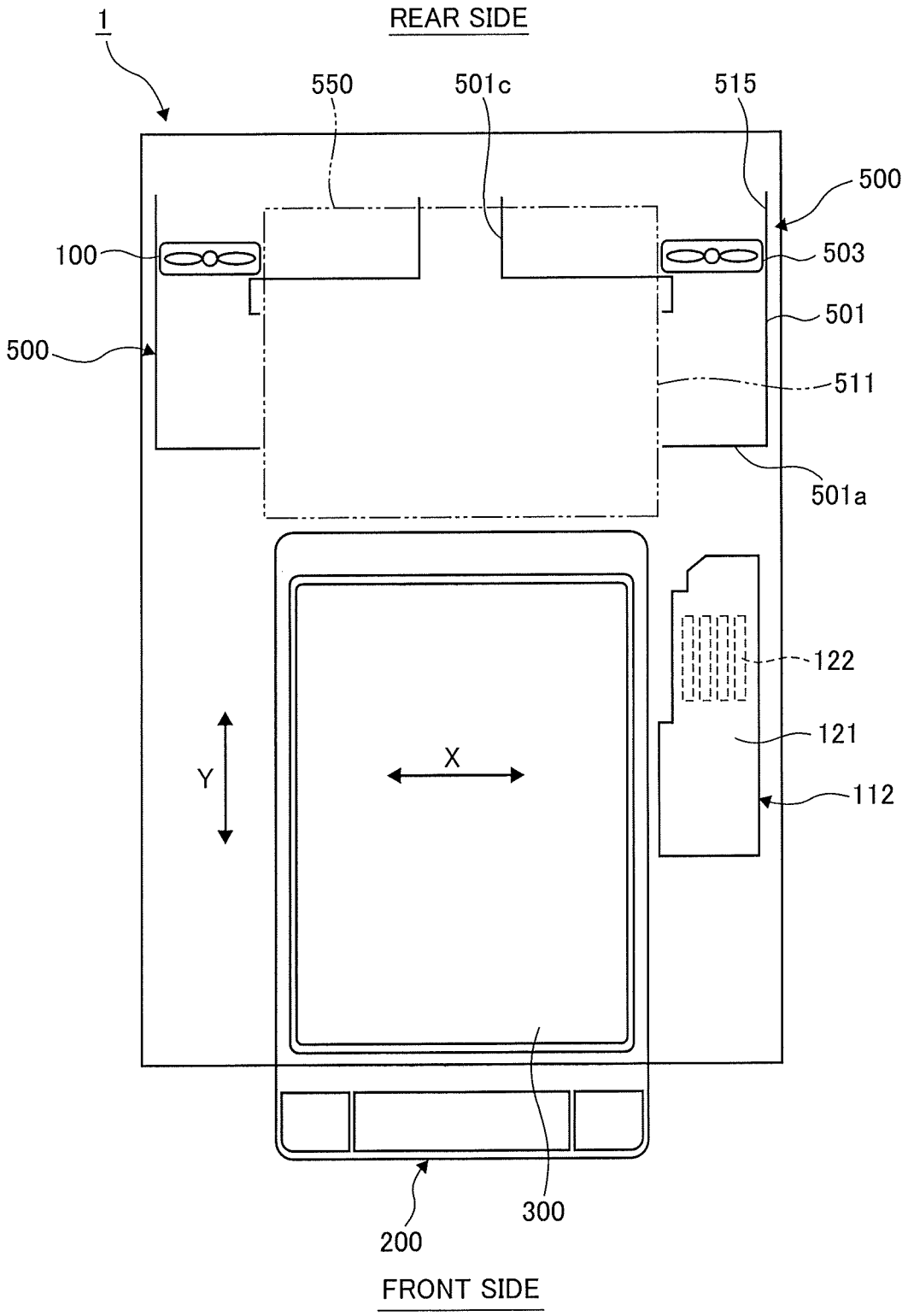
FIG. 3 is a plan view of the printing apparatus.

Hereinafter, embodiments of the present disclosure will be described with reference to the accompanying drawings. A printing apparatus as a liquid discharge apparatus according to a first embodiment of the present disclosure will be described with reference to FIGS. 1 to 3. FIG. 1 is a front view, FIG. 2 is a side view, and FIG. 3 is a plan view, of the printing apparatus.

A printing apparatus 1 includes, in an apparatus body 100; a stage 111 that reciprocates while removably holding a cassette 200; and a printing unit 112 printing on a printing medium held by the cassette 200 held by the stage 111. The cassette 200 is a holder having a platen member 300 to hold a cloth 400 (refer to FIG. 6) or the like being a printing medium as an application target object.

The stage 111 is mounted to a slider member 113, and the slider member 113 is held by guide members 114 and 114 so as to be capable of reciprocating in an arrow Y direction (feed direction). The stage 111 reciprocates with reciprocating movement of the slider member 113 in the feed direction.

This also causes reciprocating movement in the Y-direction of the cassette 200, which is a holder removably attached to the stage 111, and of the cloth 400 held by the platen member 300 of the cassette 200.

The printing unit 112 includes a carriage 121 that moves in the arrow X direction (main scanning direction) with respect to the stage 111. The carriage 121 includes a liquid discharge head 122 being a liquid discharge device that discharges a liquid.

A maintenance unit 130 that performs maintenance of the liquid discharge head 122 is disposed below the carriage 121 on one end side in the arrow X direction. The maintenance unit 130 includes a cap 131 for capping a nozzle surface of the liquid discharge head 122.

In the printing apparatus 1, the cassette 200 is mounted on the stage 111 in the apparatus body 100 and held in a state where a printing medium is set on the platen member 300 of the cassette 200. Thereafter, movement of the stage 111 in the arrow Y direction and the reciprocating movement of the printing unit 112 (the carriage 121) in the arrow X direction are repeated to enable printing a desired image on the cloth 400 as a printing medium.

Figure 4:
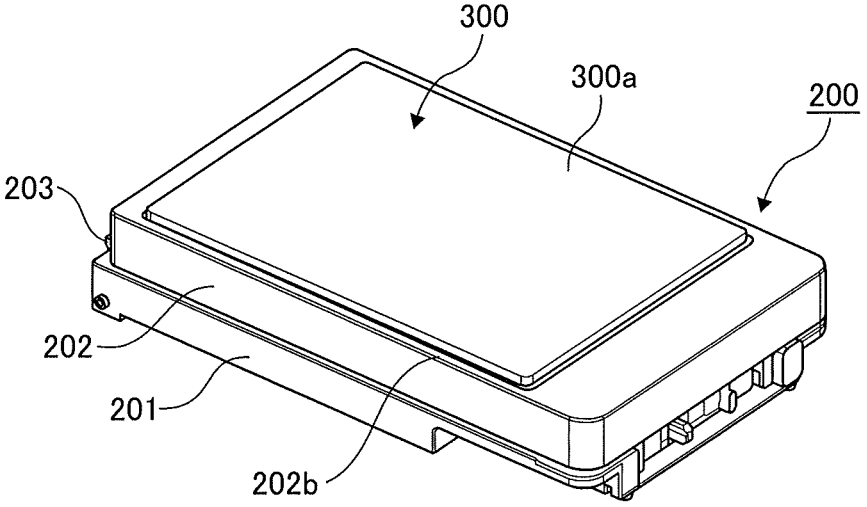
FIG. 4 is an external perspective view of an example of a cassette used in the printing apparatus.
Figure 5:
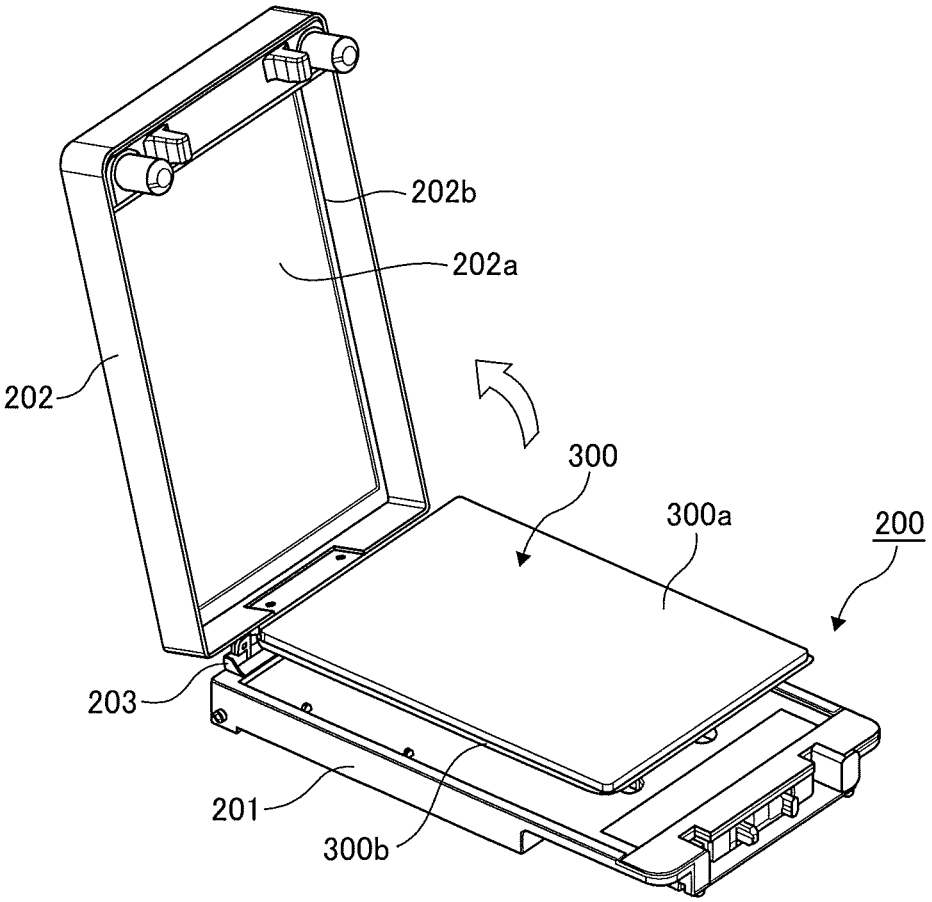
FIG. 5 is a perspective view of a state where an outer circumferential cover member of the cassette is open.
Figure 6:
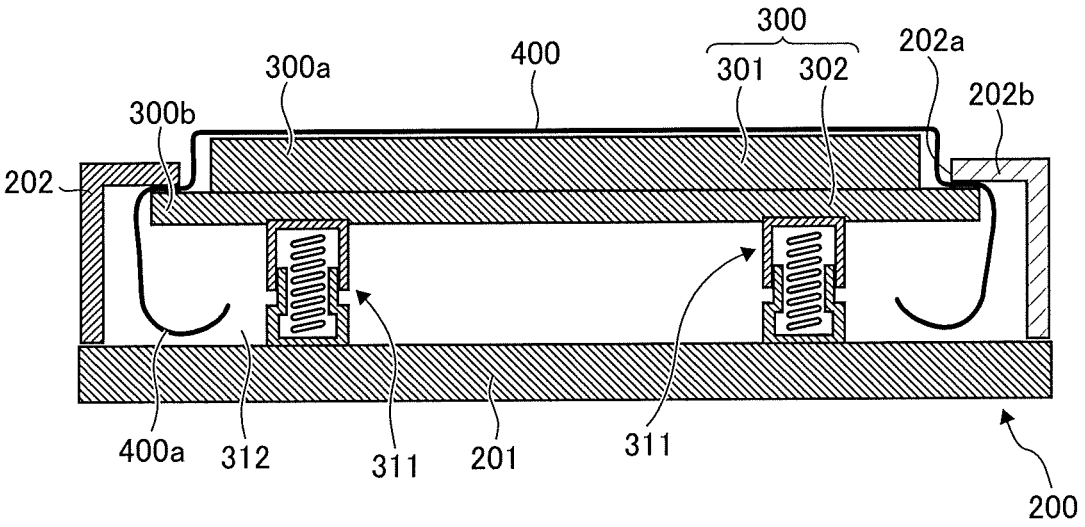
FIG. 6 is a schematic cross-sectional view along a short side direction of the cassette.

Next, an example of a cassette used in this printing apparatus will be described with reference to FIGS. 4 to 6. FIG. 4 is an external perspective view of the cassette. FIG. 5 is a perspective view of the cassette in a state where the outer circumferential cover member is open. FIG. 6 is a schematic cross-sectional view along a short side direction of the cassette.

The cassette 200 includes: a base member 201; the platen member 300 that holds a portion to be printed on the cloth 400 in a flat state; and an outer circumferential cover member 202 that sandwiches the cloth 400 between oneself and the platen member 300.

The platen member 300 is constituted with: a platen body 301 formed of a heat insulating member 300*a* constituting a holding surface that holds the cloth 400 in a flat state; and a platen structure 302. The platen body 301 has heat resistance in heat application. The platen structure 302 is integrated with the platen body 301 and projects from the outer circumferential side of the platen body 301 to form a flange portion 300*b* which is a peripheral portion of the platen member 300.

The outer circumferential cover member 202 includes a frame portion 202*b* forming an opening portion 202*a* from which the platen member 300 is exposed. The outer circumferential cover member 202 is provided so as to be openable/closable with respect to the base member 201 by a hinge 203 or the like. The outer circumferential cover member 202 holds the cloth 400 between oneself and the flange portion 300*b* of the peripheral portion of the platen member 300.

The platen member 300 is supported by a support 311 with respect to the base member 201, so as to form an accommodation space 312 between the platen member 300 and the base member 201 enabling accommodation of a residual portion 400*a* of the cloth 400. The residual portion 400*a* corresponds to both sleeves, collar portion, hem, etc. in the case of printing on the front side of a T-shirt, for example.

When holding and printing the cloth 400 on the cassette 200, the outer circumferential cover member 202 is first opened, and then, a printing portion of the cloth 400 is set on the platen member 300. Thereafter, a remaining portion (residual portion) 400*a* of the cloth 400 is pushed into the accommodation space 312, and the residual portion 400*a* is accommodated in the accommodation space 312. Thereafter, the outer circumferential cover member 202 is closed.

This procedure can hold the printing portion of the cloth 400 flat by the platen member 300, enabling accommodation of the residual portion 400*a* within the cassette 200 by suppressing its protrusion to the outside.

Thereafter, the cassette 200 in which the cloth 400 is set is mounted (set) on the stage 111 of the apparatus body 100 of the printing apparatus 1.

Figure 7:
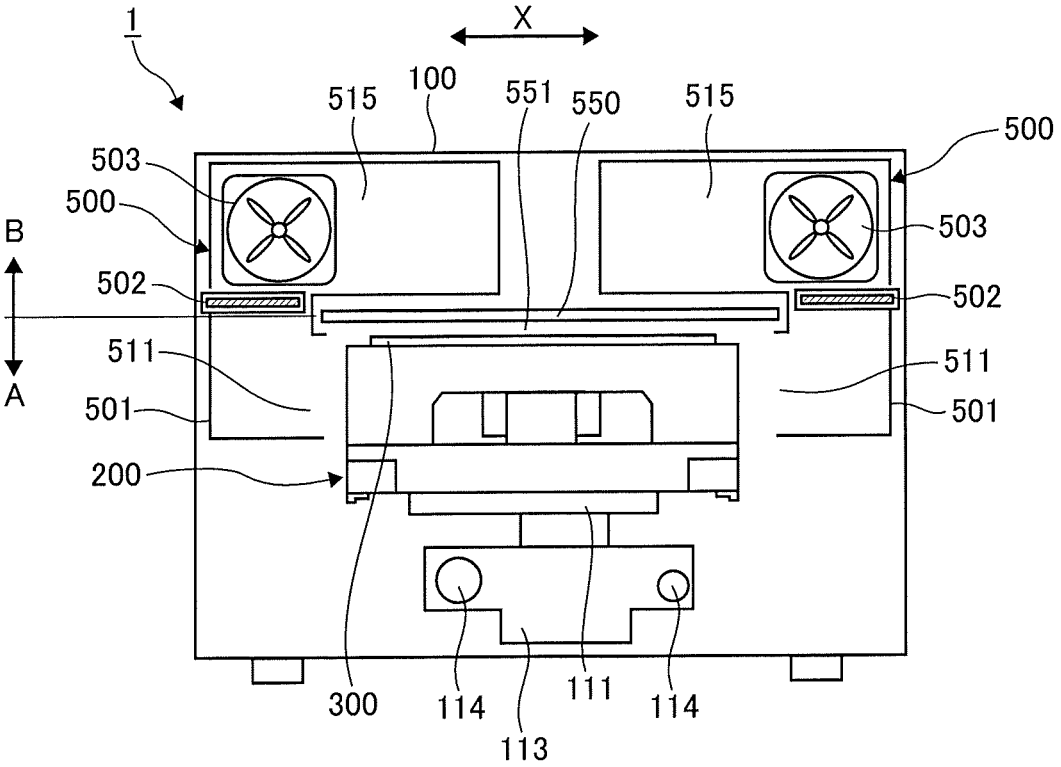
FIG. 7 is a front view illustrating a portion related to mist collection in the printing apparatus.

Next, a configuration of a portion related to mist collection in the printing apparatus 1 will be described with reference to FIG. 7 as well. FIG. 7 is a front view illustrating the printing apparatus 1.

Here, an attachment/detachment side of the cassette 200 with respect to the apparatus body 100 is defined as the front side of the apparatus body 100, and the side opposite to the front side in the arrow Y direction is defined as the rear side of the apparatus body 100.

Mist collection devices 500 are arranged at portions being both side portions of the apparatus body 100 and being the rear side of the apparatus body 100.

The mist collection device 500 includes an exhaust duct 501, a filter 502 that captures mist, and an exhaust fan 503 that is disposed on a downstream side of the filter 502 to generate an airflow.

The exhaust duct 501 includes: a suction duct portion 501*a* having a suction port 511 and that guides the air sucked from the suction port 511 upward; and an exhaust duct portion 501*c* in which the exhaust fan 503 for sucking air from the suction duct portion 501*a* via the filter 502 is arranged and that guides the air sent out from the exhaust fan 503 toward an exhaust port 515 on a rear side.

In this case, the filter 502 and the exhaust fan 503 are disposed above the suction port 511.

The suction port 511 of the exhaust duct 501 is disposed on both side portions in the X direction at substantially the same height as the cassette 200. This configuration enables suction of the mist from both sides of the cassette 200 without hindering the movement of the cassette 200.

In addition, there is provided a partition (partition plate) 550 that partitions an internal space of the apparatus body 100 into a first space A including the suction port 511 of the exhaust duct 501 and a second space B not including the suction port 511 of the exhaust duct 501.

The partition 550 is disposed at a height that would not interfere with the reciprocating cassette 200.

The partition 550 is a gap forming member that forms a spatial gap 551 (refer to FIG. 7) from the cassette 200 which is a reciprocating holder.

Figure 8:
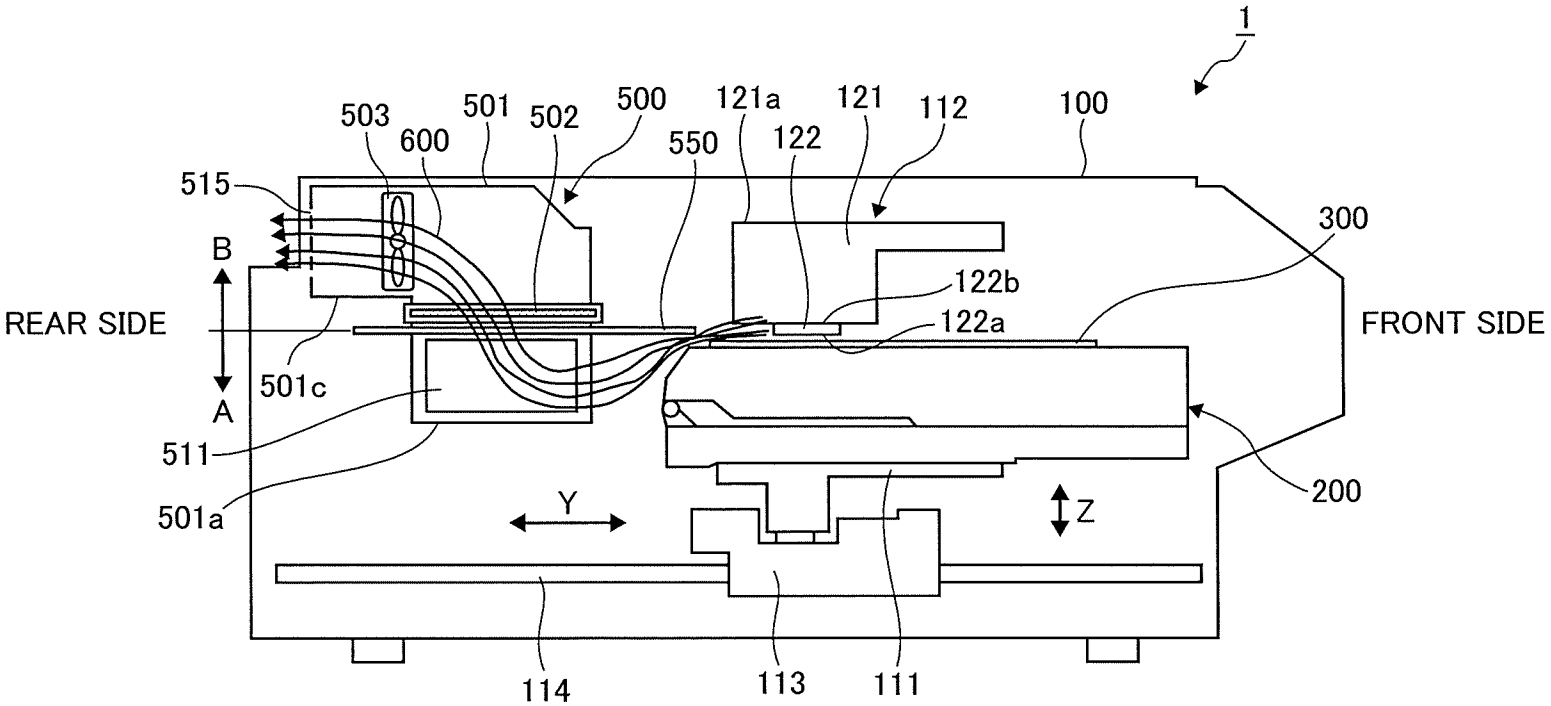
FIG. 8 is a side view of a mist collection device during mist collection.
Figure 9:
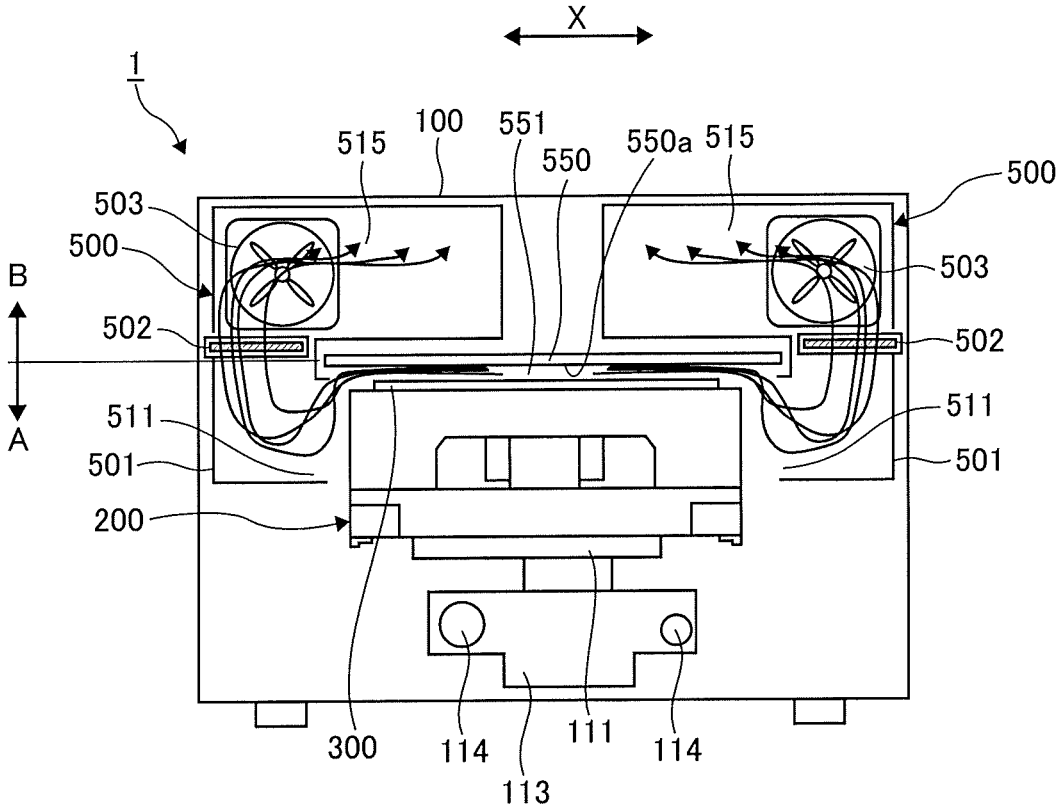
FIG. 9 is a front view of the mist collection device during mist collection.

Next, the collection of mist by the mist collection device 500 will be described with reference to FIGS. 8 and 9 as well. FIG. 8 is a side view of the mist collection device 500 and FIG. 9 is a front view of the mist collection device 500.

The exhaust fan 503 of the mist collection device 500 is driven to allow the air to be sucked from the suction port 511 and discharged from the exhaust port 515, generating an airflow 600. This airflow 600 allows the mist caused with the liquid discharge from the liquid discharge head 122 during printing on the cloth 400 and the mist generated in the maintenance of the liquid discharge head 122 performed by the maintenance unit 130 to be sucked from the suction port 511 of the exhaust duct 501 via the airflow 600.

The sucked mist is captured and collected by the filter 502 on an upstream side of the exhaust fan 503 in a direction of the airflow 600. Note that the filter 502 can be omitted or may be disposed on the downstream side of the exhaust fan 503 in the direction of the airflow 600 when mist sticking to the exhaust fan 503 would not be a problem.

Here, the suction port 511 is disposed on the side-portion side of the cassette 200, and a partition 550 is arranged to partition the space into the space A including the suction port 511 and the space B not including the suction port 511.

Such a configuration forms an airflow path of the airflow 600 passing by the side surface of the cassette 200 from the space between the partition 550 and the upper surface of the cassette 200 toward the suction port 511. At this time, the partition 550 makes it possible to efficiently guide the airflow 600 from the printing unit 112 as a mist occurrence site toward the suction port 511, achieving efficient mist collection.

Furthermore, the suction port 511 is arranged on the side-portion side of the movement range of the cassette 200, making it possible to separate contamination in the vicinity of the suction port 511 where stagnation of the airflow 600 is likely to occur from the printing medium.

Furthermore, the partition 550 is disposed at a position aligned with an upper portion of the suction port 511. Accordingly, even when the airflow 600 is disturbed by the operation of the cassette 200, the airflow 600 can be easily guided to the suction port 511. At this time, there is always a flow attributed to the airflow 600, making it possible to prevent sticking of the mist to the partition 550 itself.

With this configuration, even when the airflow 600 inside the apparatus body 100 is disturbed by the reciprocating movement of the carriage 121, the stage 111, and the cassette 200, it is still possible to prevent sticking of the mist to the partition 550 located directly above the cloth 400. This leads to prevention of dripping and sticking of the contamination attributed to the mist onto the printing medium even after use for a long period of time.

Figure 10:
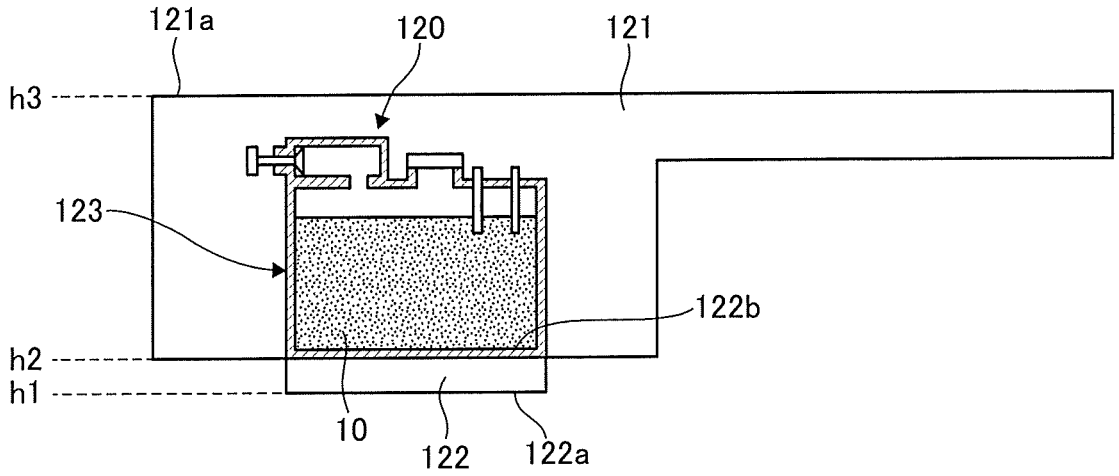
FIG. 10 is a side view of a carriage portion illustrating arrangement position of a partition as a gap forming member.
Figure 11:
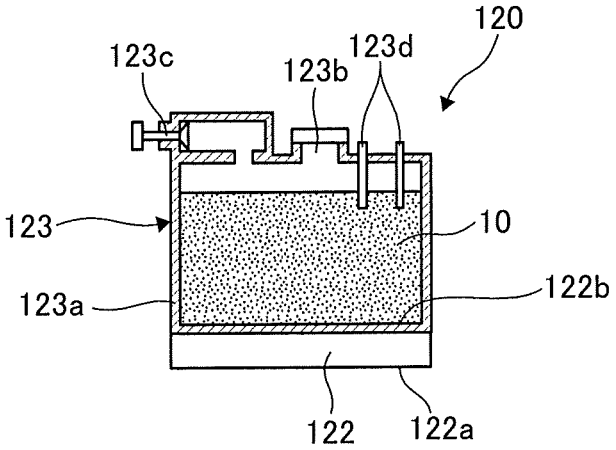
FIG. 11 is a view illustrating a discharge unit.

Next, the arrangement position of the partition 550 as the gap forming member will be described with reference to FIGS. 10 and 11 as well. FIG. 10 is a side view of a carriage portion. FIG. 11 is a view illustrating a discharge unit.

In the present embodiment, the carriage 121 includes a discharge unit 120 integrating: the liquid discharge head 122; and a sub tank 123 for temporarily storing the liquid to be supplied to the liquid discharge head 122.

The sub tank 123 includes: a tank body 123*a* constituting a housing for accommodating a liquid 10; a supply port 123*b* supplying the liquid into the tank body 123*a*; a venting mechanism 123*c* for venting the inside of the tank body 123*a*; and an electrode pin pair 123*d* for detecting a liquid level within the tank body 123*a*, or the like. Here, as illustrated in FIG. 10, a height of a nozzle surface 122*a* of the liquid discharge head 122 is defined as h1, a height of an upper surface 122*b* of the liquid discharge head 122 is defined as h2, and a height of an upper surface 121*a* of the carriage 121 is defined as h3 (h1<h2<h3).

With reference to above-described FIG. 8 as well, the partition 550 is disposed at a position where a lower surface (surface opposed to the cassette 200 as the holder) 550*a* of the partition 550 is higher than the height h1 of the nozzle surface 122*a* of the head 122.

Meanwhile, the partition 550 is preferably disposed at a position where the lower surface 550*a* of the partition 550 is lower than the height h3 of the upper surface 121*a* of the carriage 121. More preferably, the lower surface 550*a* of the partition 550 is disposed at a position lower than the height h2 of the upper surface 122*b* of the head 122.

Figure 12:
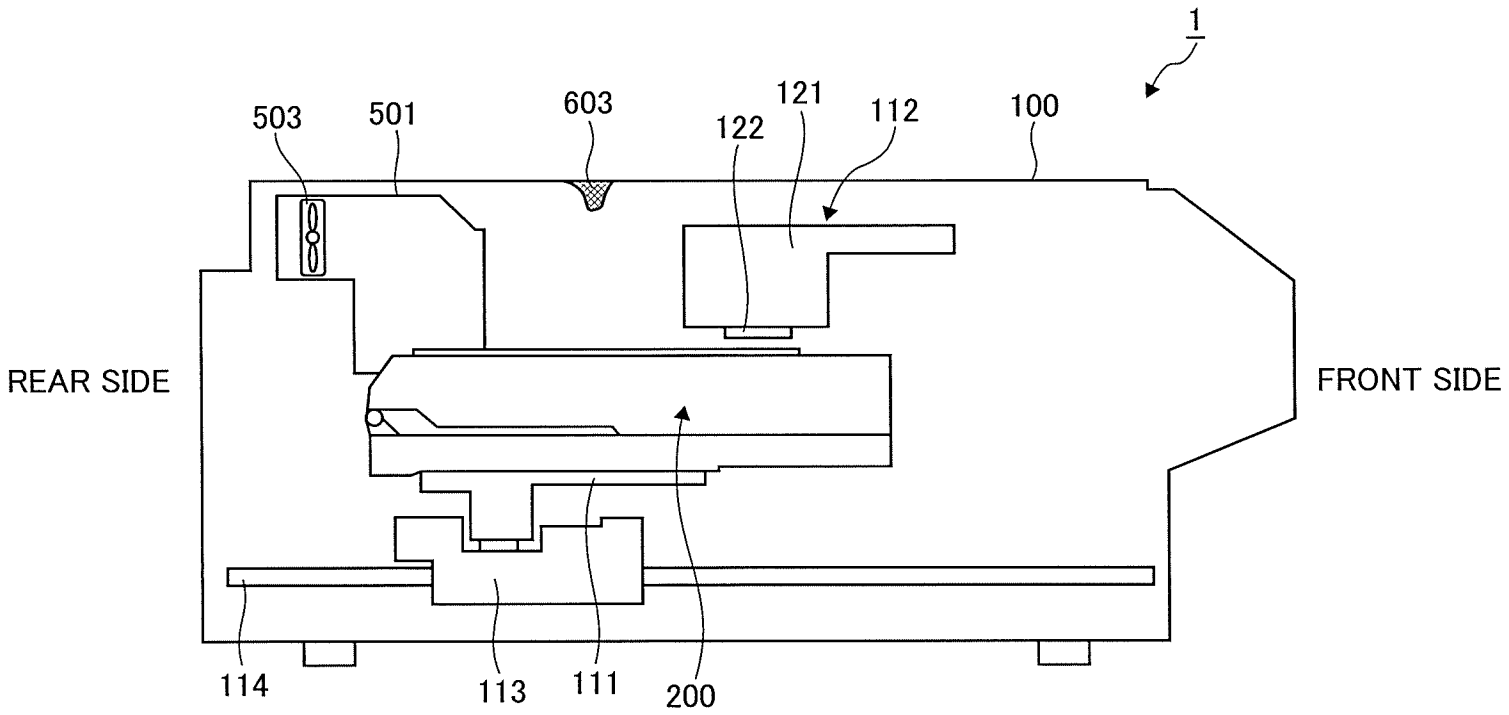
FIG. 12 is a side view illustrating occurrence of mist accumulation in the absence of a partition.

Next, operation of the partition 550 will be described with reference to FIG. 12 as well. FIG. 12 is a side view illustrating occurrence of mist accumulation in the absence of the partition 550 provided for the description.

As described above, mist is generated together with liquid discharge from the liquid discharge head 122 during printing on a printing medium, or with maintenance of the liquid discharge head 122 performed by the maintenance unit 130.

Therefore, it would be necessary, in constructing the mist collection device 500, to arrange the suction port 511 in the vicinity of the maintenance unit 130 and the carriage 121. This, however, needs to avoid moving regions of the carriage 121, the stage 111, and the cassette 200.

In addition, movement of the carriage 121, the stage 111, and the cassette 200 disturbs the airflow 600 in the apparatus body 100, causing sticking of the mist to various sites inside the apparatus body 100. During a long time of use in particular, the mist would continuously stick to the interior of the apparatus body 100, and the mist attached to the upper surface might fall down in the form of mist accumulation like icicle.

For example, even when the exhaust duct 501 and the fan 503 are disposed as illustrated in FIG. 12, rearward movement of the cassette 200 would push out the air behind the cassette 200 to generate an airflow heading toward the top surface side. The airflow heading toward the top surface side stagnates on the top surface side of the apparatus body 100, resulting in generation and growth of mist accumulation 603.

A liquid material as an aggregate of mist that falls from the mist accumulation 603 might stick to a printing medium such as the cloth 400 held by the cassette 200 moving at a lower position, leading to contamination of the printing medium in some cases.

Therefore, according to the present embodiment, the suction port 511 is disposed on the side-portion side of the cassette 200 and the space is partitioned into the space A including the suction port 511 and the space B not including the suction port 511 by using the partition 550, so as to allow the airflow 600 to constantly flow over the surface of the partition 550 on the cassette 200 side.

This would suppress occurrence of mist accumulation on the partition 550, making it possible to prevent the liquid material being aggregation of the mist from dripping onto the cassette 200.

Figure 13:
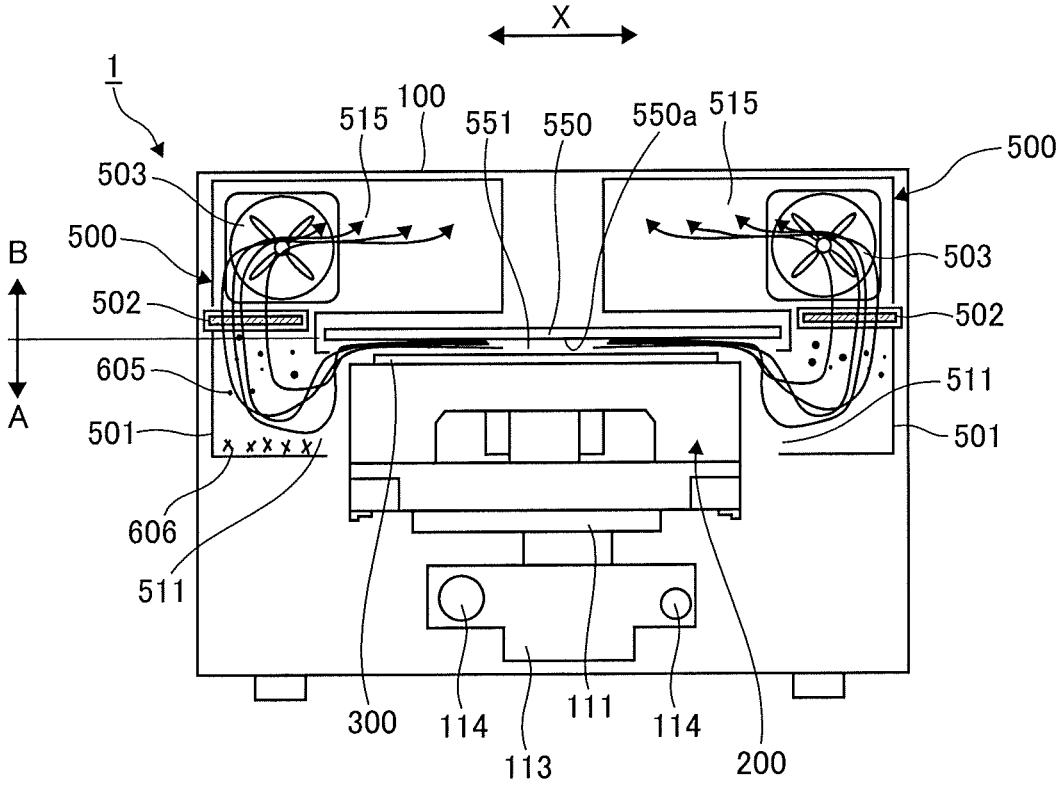
FIG. 13 is a front view illustrating operation of a configuration in which an exhaust fan and a filter are arranged above a suction port.

Next, operation of the configuration in which the exhaust fan 503 and the filter 502 are disposed above the suction port 511 will be described with reference to FIG. 13 as well. FIG. 13 is a front view illustrating the same situation.

When the printing medium is the cloth 400, there is a case where unnecessary fiber pieces such as fragments of fibers are stuck to the printing medium. When such a fiber piece is sucked into the mist collection device 500, adsorption of mist to the fiber piece would cause solidification, leading to malfunction of the exhaust fan 503 and clogging of the filter 502.

To cope with this, the exhaust fan 503 and the filter 502 are arranged above the suction port 511. With this arrangement, a light mist 605 is sucked upward by the exhaust fan 503, and even in a case where a heavy fiber piece 606 is sucked by the suction port 511, it falls down and would not reach the exhaust fan 503 or the filter 502, as illustrated in FIG. 13.

This makes it possible prevent malfunction of the exhaust fan 503 and clogging of the filter 502.

Figure 14:
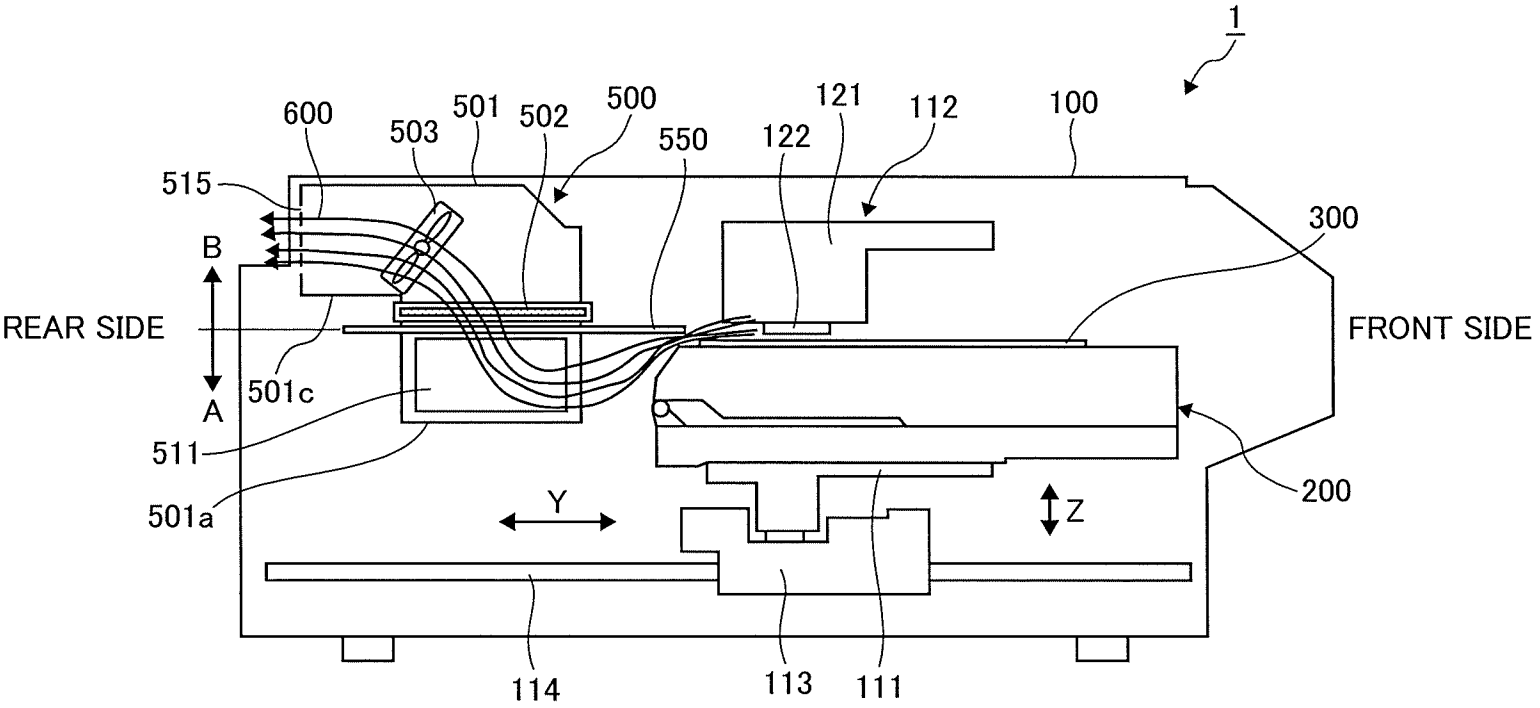
FIG. 14 is a side view illustrating a second embodiment of the present disclosure.
Figure 15:
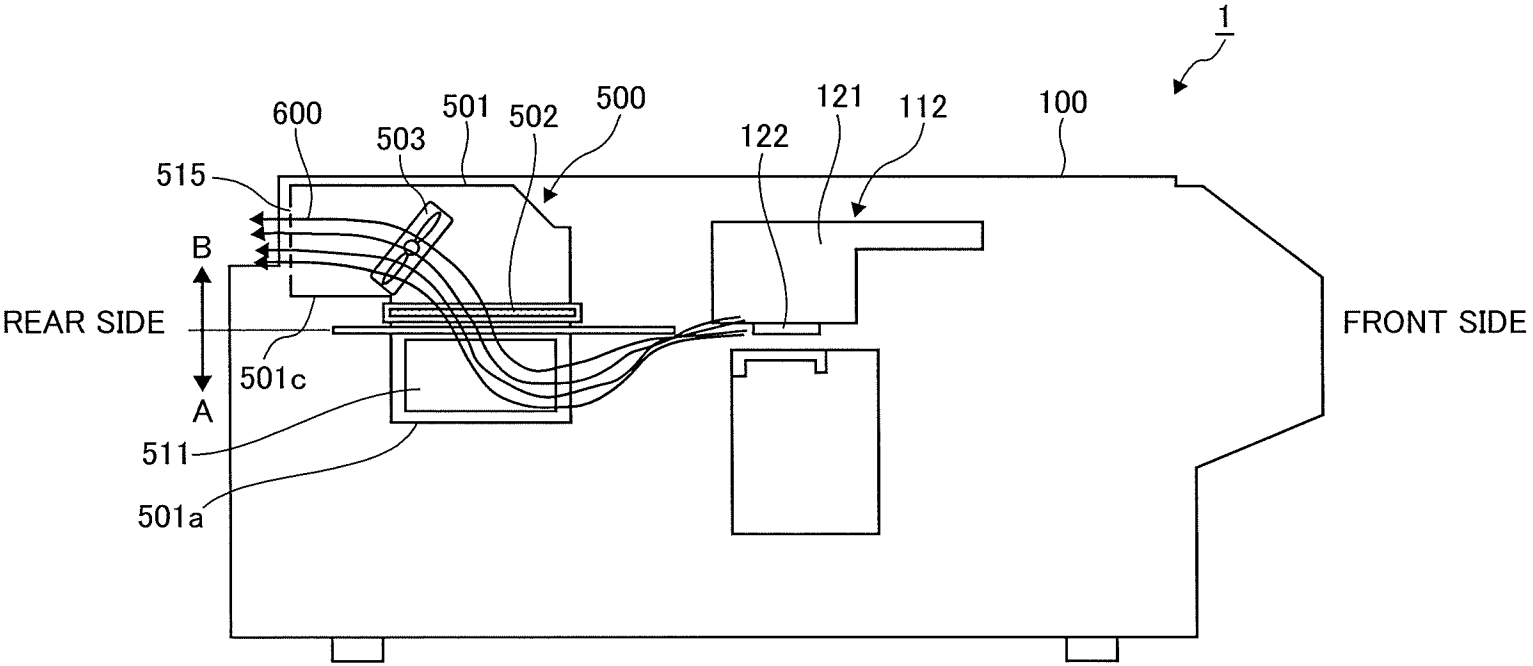
FIG. 15 is a side view illustrating operational effects of the second embodiment.

Next, a second embodiment of the present disclosure will be described with reference to FIGS. 14 and 15. FIG. 14 is a side view illustrating the same embodiment. FIG. 15 is a side view illustrating operational effects of the same embodiment.

In the present embodiment, the exhaust fan 503 is disposed in a posture inclined so as to face diagonally down toward the upstream side in the direction of the airflow 600.

That is, since the mist occurs at the time of printing or maintenance, arranging the suction port 511 in the vicinity of the liquid discharge head 122 (near the carriage 121) would increase the mist collection efficiency. However, as illustrated in FIG. 15, the maintenance unit 130 is disposed just under the cassette 200 after movement of the liquid discharge head 122 to the home position (to the right in the X-direction), making it difficult to arrange the suction port 511 on a side-surface side of the cassette 200.

Since there is a need to arrange the suction port 511 at a position to avoid the maintenance unit 130, and thus, the suction port 511 is arranged on the rear side of the apparatus body 100 in the present embodiment.

Therefore, the exhaust fan 503 is disposed to face diagonally down toward the upstream side, inclined toward the liquid discharge head 122 side. This makes it easy to suck the air from below by the exhaust fan 503, leading to an increase in the amount of mist to suck. Even in a case where the exhaust fan 503 is disposed above the suction port 511, a sufficient airflow 600 can be generated.

Figure 16:
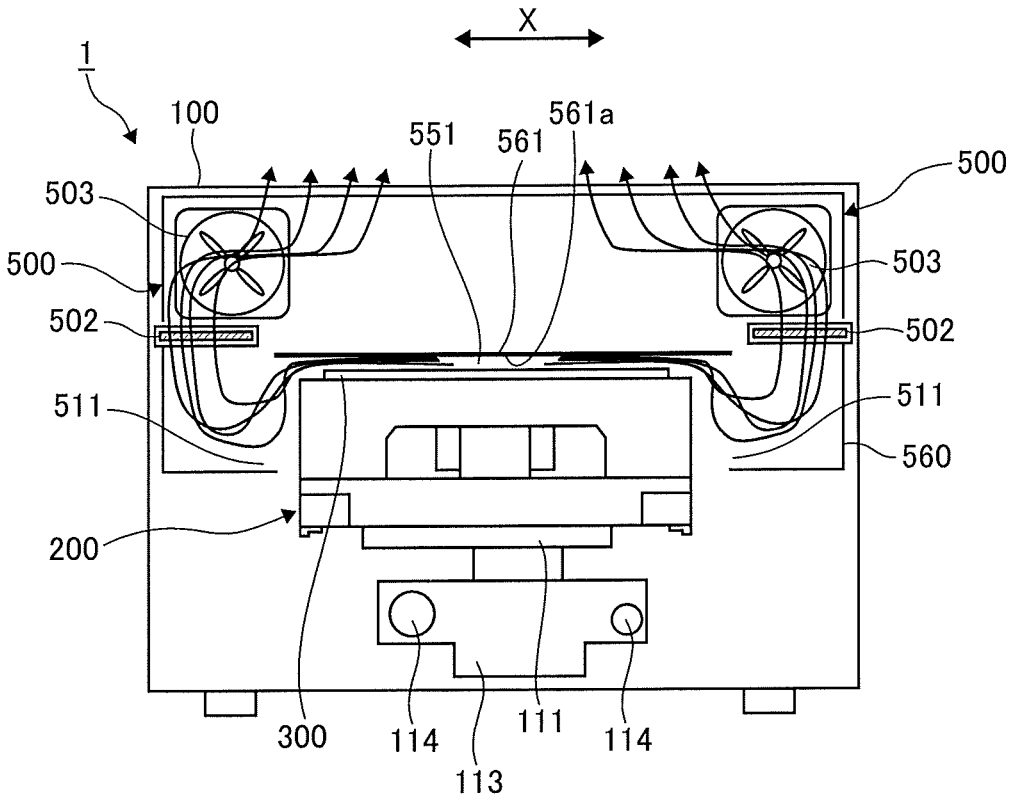
FIG. 16 is a front view illustrating a third embodiment of the present disclosure.
Figure 17:
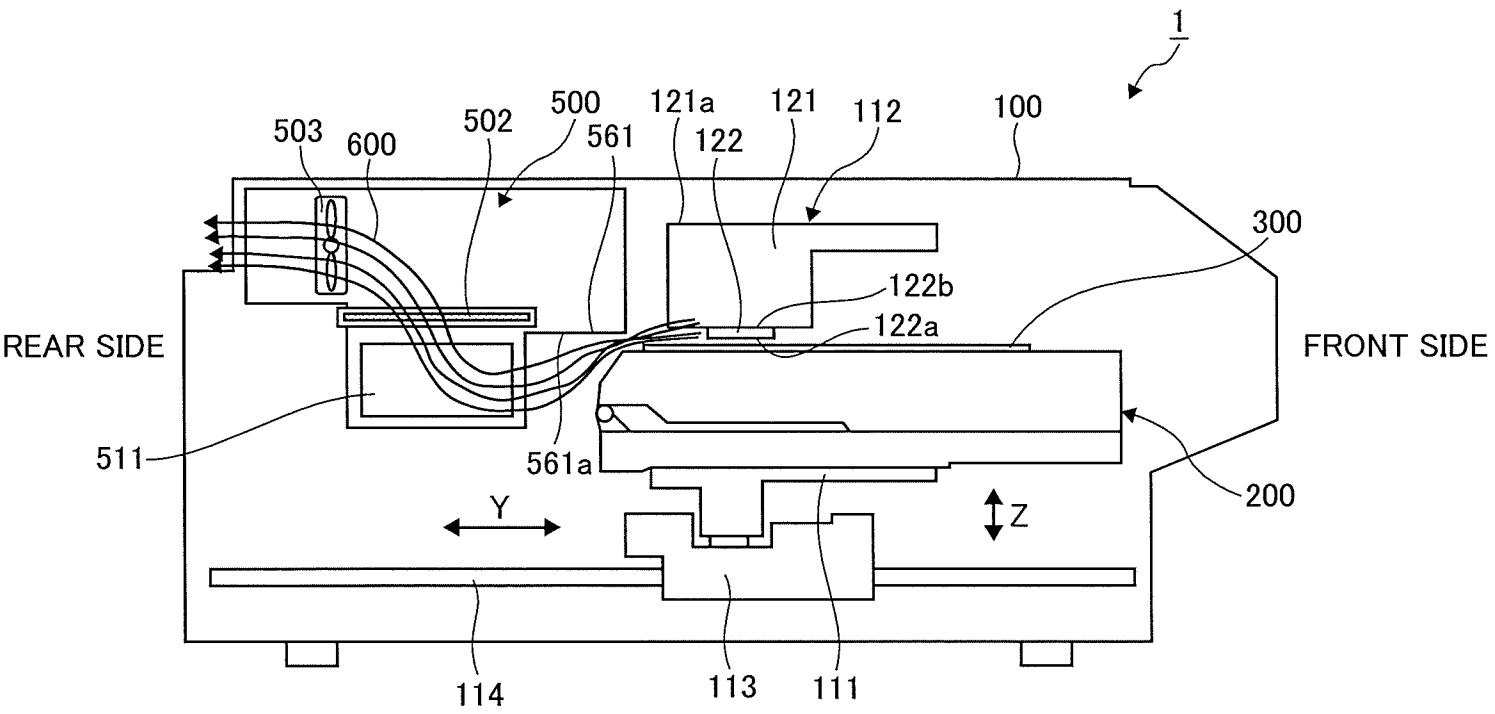
FIG. 17 is a side view of the third embodiment.

Next, a third embodiment of the present disclosure will be described with reference to FIGS. 16 and 17. FIG. 16 is a front view illustrating the same embodiment. FIG. 17 is a side view of the same embodiment.

In the present embodiment, a lowered ceiling portion 561 as a portion of a casing 560 of the mist collection device 500 also serves as a gap forming member. The lowered ceiling portion 561 is lowered to the position of the lower surface 550*a* of the partition 550 of the embodiment, forming a spatial gap 551 between the lowered ceiling portion 561 and the cassette 200.

In this case, a lower surface 561*a* of the lowered ceiling portion 561 is arranged at a position higher than the nozzle surface 122*a* of the head 122. Meanwhile, the lower surface 561*a* of the lowered ceiling portion 561 is preferably disposed at a position lower than the upper surface 121*a* of the carriage 121. More preferably, the lower surface 561*a* of the lowered ceiling portion 561 is disposed at a position lower than the upper surface 122*b* of the head 122.

This configuration also makes it possible to obtain the operational effects similar to the above embodiment.

Figure 18:
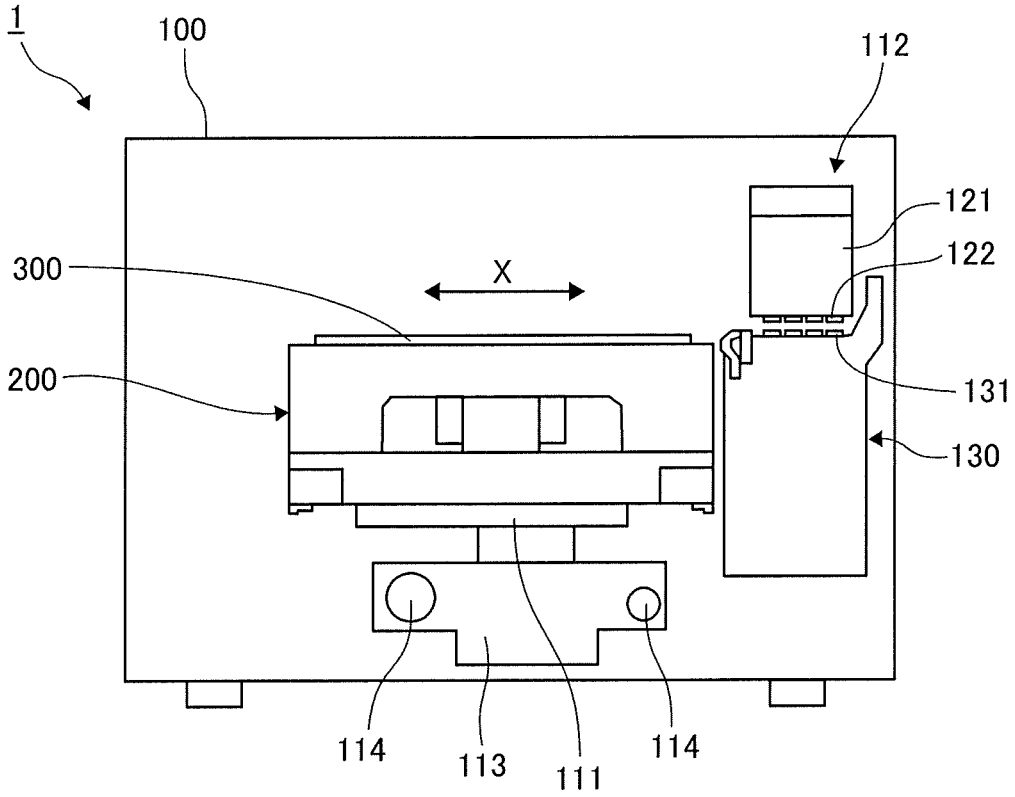
FIG. 18 is a front view of a printing apparatus as a liquid discharge apparatus according to a fourth embodiment of the present disclosure.
Figure 19:
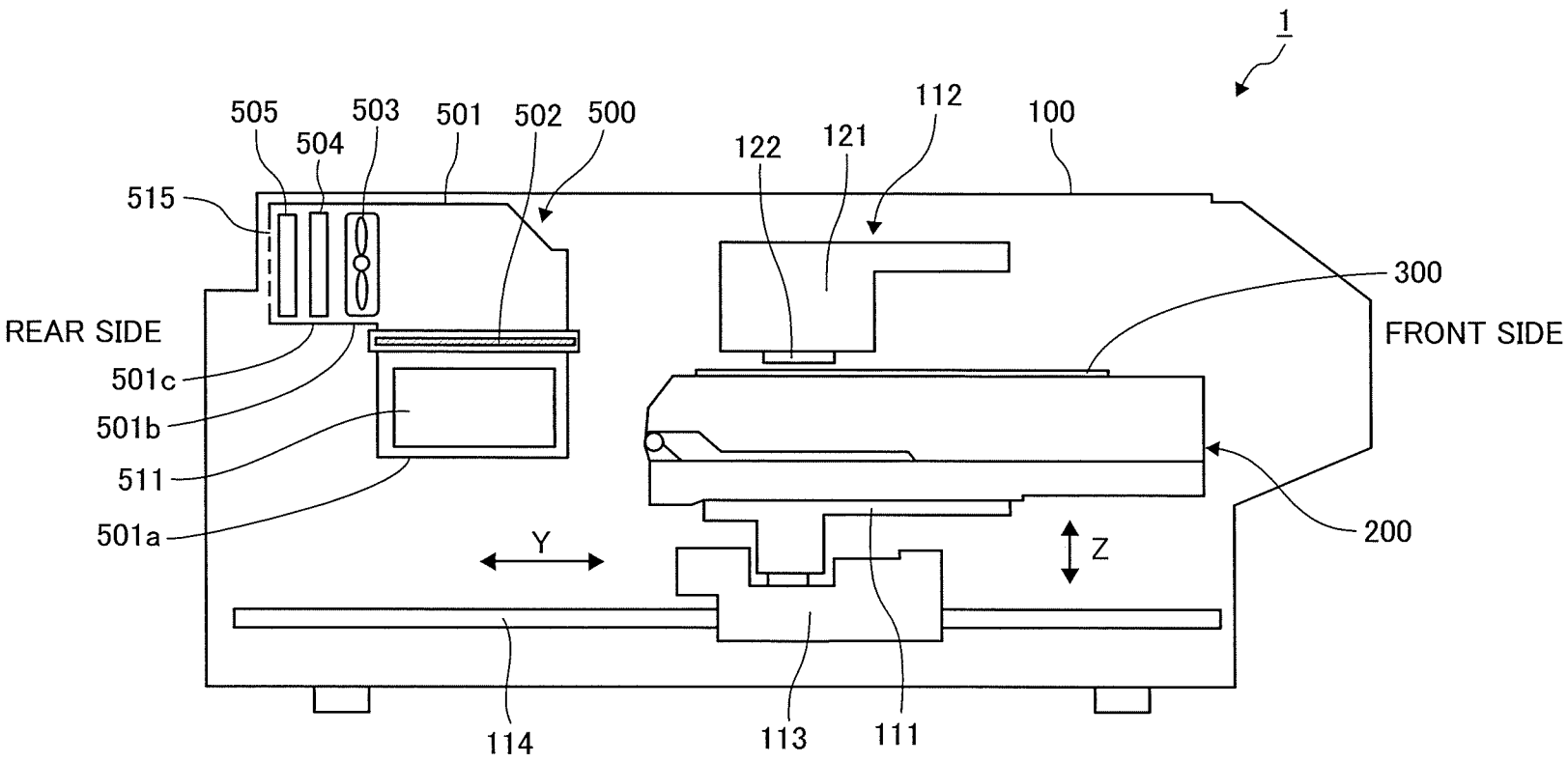
FIG. 19 is a side view of the printing apparatus of FIG. 18.
Figure 20:
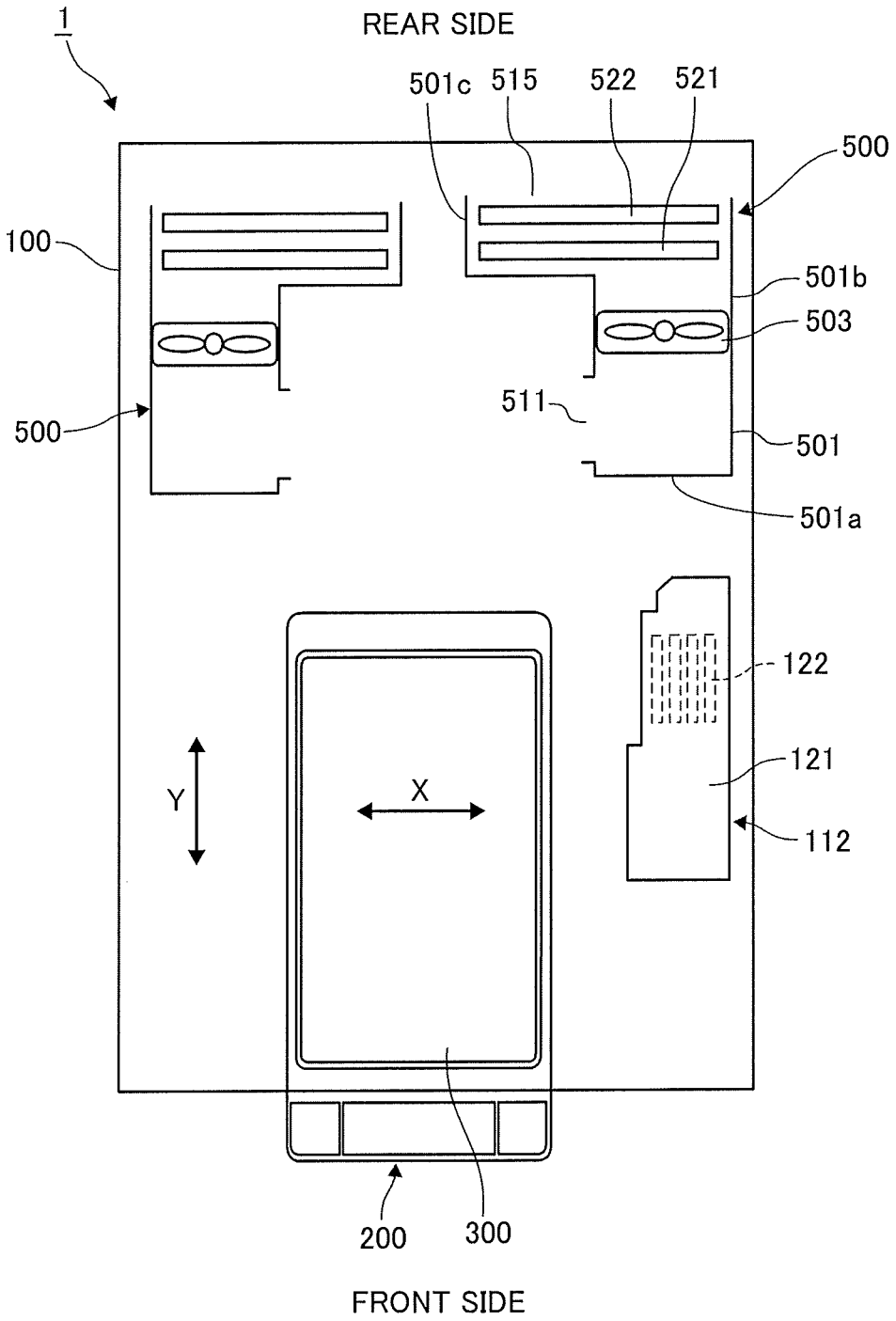
FIG. 20 is a plan view of the printing apparatus of FIG. 18.

A printing apparatus as a liquid discharge apparatus according to a fourth embodiment of the present disclosure will be described with reference to FIGS. 18 to 20. FIG. 18 is a front view of the printing apparatus. FIG. 19 is a side view of the same. FIG. 20 is a plan view of the same.

The printing apparatus 1 includes, in the apparatus body 100, the stage 111 to which the cassette 200 having the platen member 300 for holding cloth or the like as a printing medium is removably attached and which reciprocates while holding the cassette 200; and the printing unit 112 printing on the printing medium held by the cassette 200 held by the stage 111.

The stage 111 is mounted to a slider member 113, and the slider member 113 is held by guide members 114 and 114 so as to be capable of reciprocating in an arrow Y direction (feed direction). The stage 111 reciprocates with reciprocating movement of the slider member 113 in the feed direction. This also causes reciprocating movement in the Y-direction in the cassette 200 removably attached to the stage 111, and the printing medium held by the platen member 300 of the cassette 200.

The printing unit 112 includes a carriage 121 that moves in the arrow X direction (main scanning direction) with respect to the stage 111. The carriage 121 includes the liquid discharge head 122 being a liquid discharge device that discharges a liquid.

The maintenance unit 130 that performs maintenance of the liquid discharge head 122 is disposed below the carriage 121 on one end side in the arrow X direction. The maintenance unit 130 includes the cap 131 for capping a nozzle surface of the liquid discharge head 122.

In the printing apparatus 1, the cassette 200 is mounted on the stage 111 in the apparatus body 100 and held in a state where a printing medium is set on the platen member 300 of the cassette 200. Thereafter, movement of the stage 111 in the arrow Y direction and the reciprocating movement of the printing unit 112 (the carriage 121) in the arrow X direction are repeated to enable printing a desired image on the printing medium.

Here, an attachment/detachment side of the cassette 200 with respect to the apparatus body 100 is defined as the front side of the apparatus body 100, and the side opposite to the front side in the arrow Y direction is defined as the rear side of the apparatus body 100.

In the printing apparatus 1 of the present embodiment, mist collection devices 500 and 500 according to an embodiment of the present disclosure are arranged at portions being both side portions of the apparatus body 100 and being the rear side of the apparatus body 100.

The mist collection device 500 includes: the exhaust duct 501, the filter 502 that captures mist, the exhaust fan 503 that generates the airflow 600 passing through the filter 502, a first opening member 504, and a second opening member 505.

The exhaust duct 501 includes: the suction duct portion 501*a* having the suction port 511 at a substantially same height as the cassette 200 and that guides the sucked air upward; an intermediate duct portion 501*b* in which the exhaust fan 503 that sucks the air from the suction duct portion 501*a* via the filter 502 is arranged; and the exhaust duct portion 501*c* that guides the air sent out from the exhaust fan 503 toward an exhaust port 515 on a rear side.

Here, the width of the exhaust duct portion 501*c* in the arrow Y direction is set to be wider than the width of the intermediate duct portion 501*b* in the arrow X direction.

The exhaust duct portion 501*c* includes the first opening member 504 and the second opening member 505 constituting a plurality of opening members being sequentially arranged from the exhaust fan 503 side on the downstream side of the exhaust fan 503 and on the upstream side of the exhaust port 515 in the direction of the airflow 600.

This configuration makes the width of the first opening member 504 and the second opening member 505 in the arrow X direction larger than the diameter of the exhaust fan 503. That is, the exhaust fan 503 is offset with respect to each of the first opening member 504 and the second opening member 505.

Figure 21:
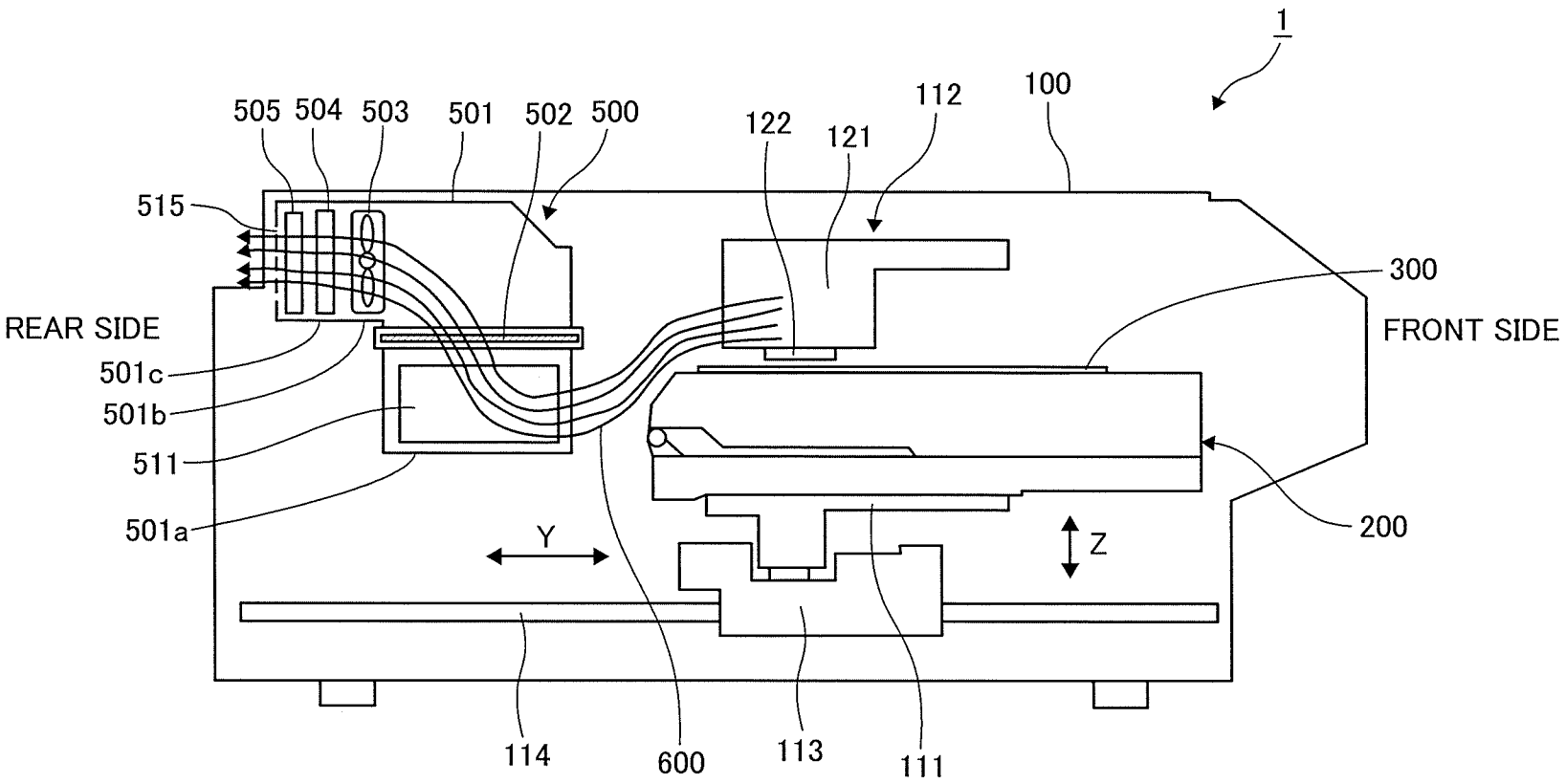
FIG. 21 is a side view illustrating a flow of air when a mist collection device in the fourth embodiment is driven.

Next, a flow of air when the mist collection device 500 is driven will be described with reference to FIG. 21. FIG. 21 is a side view illustrating the same situation.

The exhaust fan 503 of the mist collection device 500 is driven to suck the air in the apparatus body 100 from the suction port 511 of the exhaust duct 501, generating the airflow 600. The airflow 600 is sucked into the suction duct portion 501*a* from the vicinity of the carriage 121, passes through the filter 502, so as to be sent out from the exhaust fan 503, then, passes through the first opening member 504 and the second opening member 505 to be blown out from the exhaust port 515.

Figure 22A:
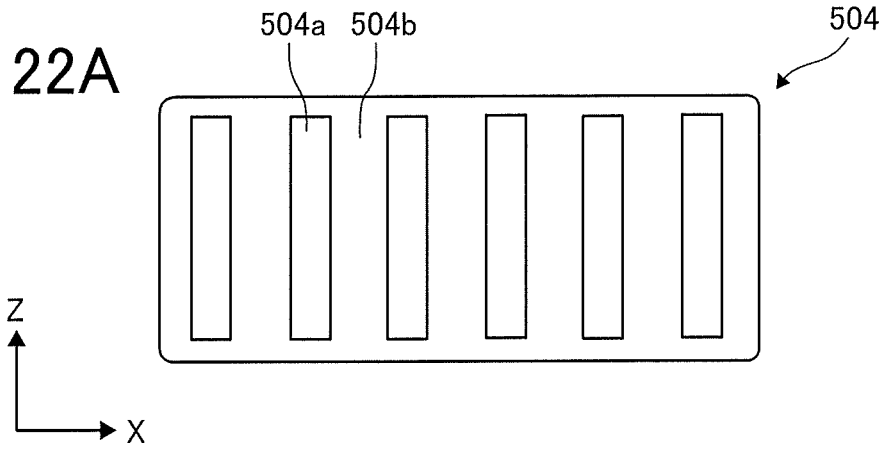
FIGS. 22A to 22C are front views illustrating a first opening member and a second opening member in the fourth embodiment.
Figure 22B:
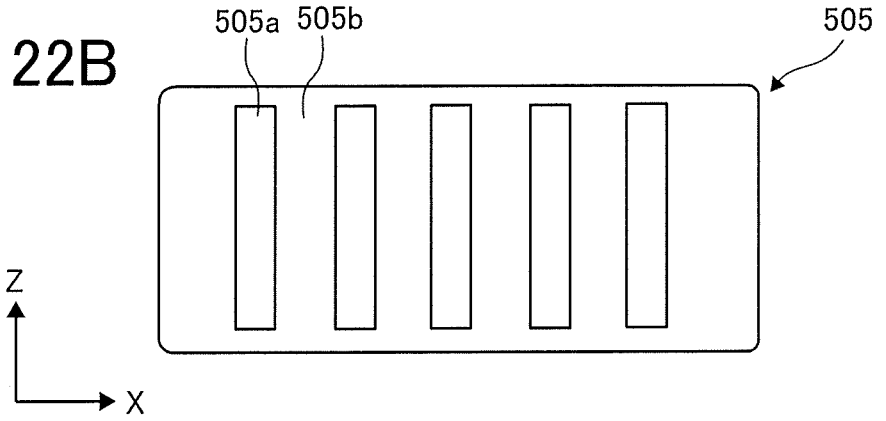
Figure 22C:
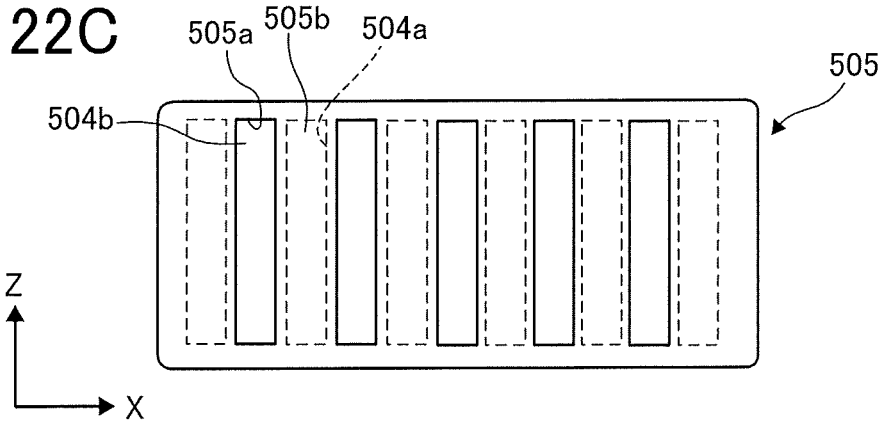
Figure 23:
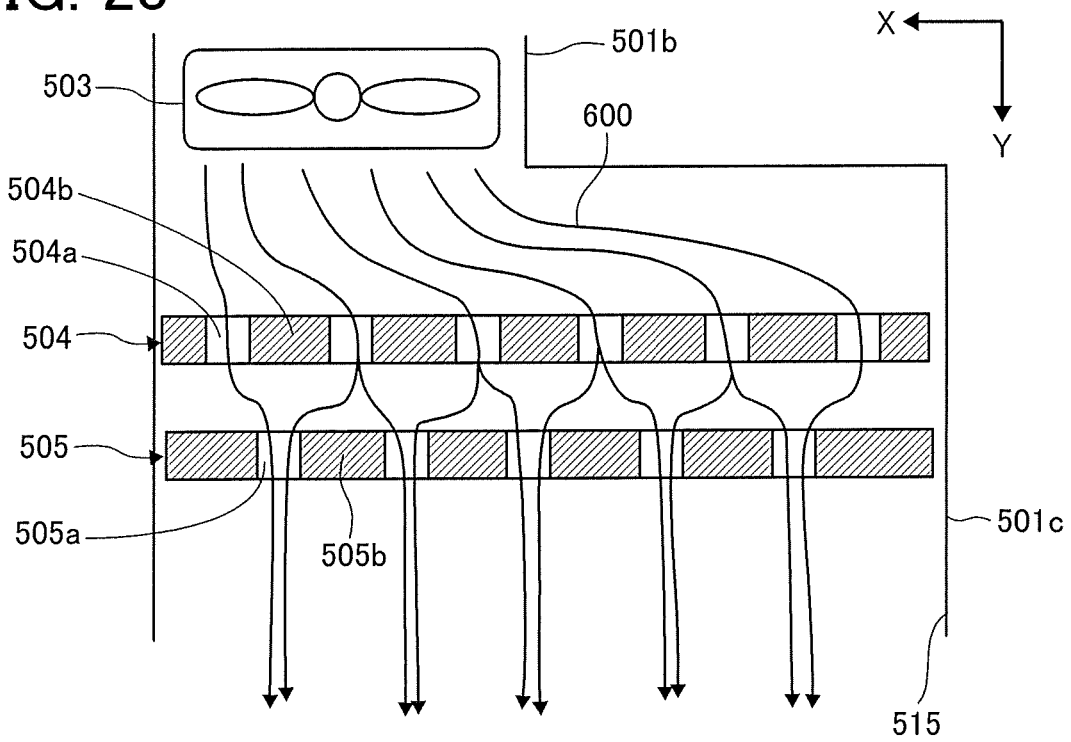
FIG. 23 is a cross-sectional plan view of a portion from an exhaust fan to an exhaust port in the fourth embodiment.

Next, the first opening member and the second opening member in the fourth embodiment will be described with reference to FIGS. 22 and 23. FIGS. 22A to 22C are front views illustrating the first opening member 504 and the second opening member 505. Specifically, FIG. 22A is a front view of the first opening member 504, FIG. 22B is a second opening member 505, FIG. 22C is a view from a direction in which the first opening member 504 and the second opening member 505 overlaps with each other. FIG. 23 is a cross-sectional plan view of a portion from the exhaust fan 503 to the exhaust port 515.

The first opening member 504 includes: a plurality of slit-shaped first opening portions 504*a* that allows passage of the airflow 600; and a wall portion 504*b* that blocks passage of the airflow 600, being a portion other than the first opening portion 504*a*.

The second opening member 505 has a plurality of slit-shaped second opening portions 505*a* through which the airflow 600 passes; and a wall portion 505*b* other than the second opening portion 505*a* that blocks passage of the airflow 600.

In the present embodiment, the plurality of first opening portions 504*a* of the first opening member 504 and the plurality of second opening portions 505*a* of the second opening members 505 are each arranged in the X direction.

As illustrated in FIGS. 22C and 23, among the first opening member 504 and the second opening member 505 which are adjacent two opening members, the first opening portion 504*a* of the first opening member 504 serving as the opening member on the upstream side is arranged to be opposed to the wall portion 505*b* of the second opening member 505 which is an opening member on the downstream side in the direction of the airflow 600.

While the present embodiment has a configuration in which all of the first opening portions 504*a* of the first opening member 504 on the upstream side are entirely opposed to the wall portion 505*b* of the second opening member 505 on the downstream side, embodiments of the present disclosure are not limited to such a configuration.

With such a configuration, the airflow 600 blown out from the exhaust fan 503 flows directly into the first opening portion 504*a* of the first opening member 504 or changes its direction at the wall portion 504*b* to pass through the first opening portion 504*a*, as illustrated in FIG. 23.

In this embodiment, the airflow 600 that has passed through the first opening portion 504*a* of the first opening member 504 collides with the wall portion 505*b* of the second opening member 505 to change its direction, so as to pass through the second opening portion 505*a* of the second opening member 505 and is discharged to the outside from the exhaust port 515.

Here, the airflow 600 blown out from the exhaust fan 503 contains mist that has not been collected by the filter 502.

At this time, the airflow 600 passes meandering through the first opening portion 504*a* of the first opening member 504 and then the second opening portion 505*a* of the second opening member 505, resulting in a decrease in the flow velocity of the airflow 600. Therefore, the mist contained in the airflow 600 easily sticks to the wall surface of the exhaust duct 501, the wall portion 504*b* of the first opening member 504, the wall portion 505*b* of the second opening member 505, or the like.

This achieves reduction of the mist discharged from the exhaust port 515.

Note that with the use of the first opening portion 504*a* and the second opening portion 505*a* as slit-shaped openings as in the present embodiment, the shape can be simplified.

Figure 24:
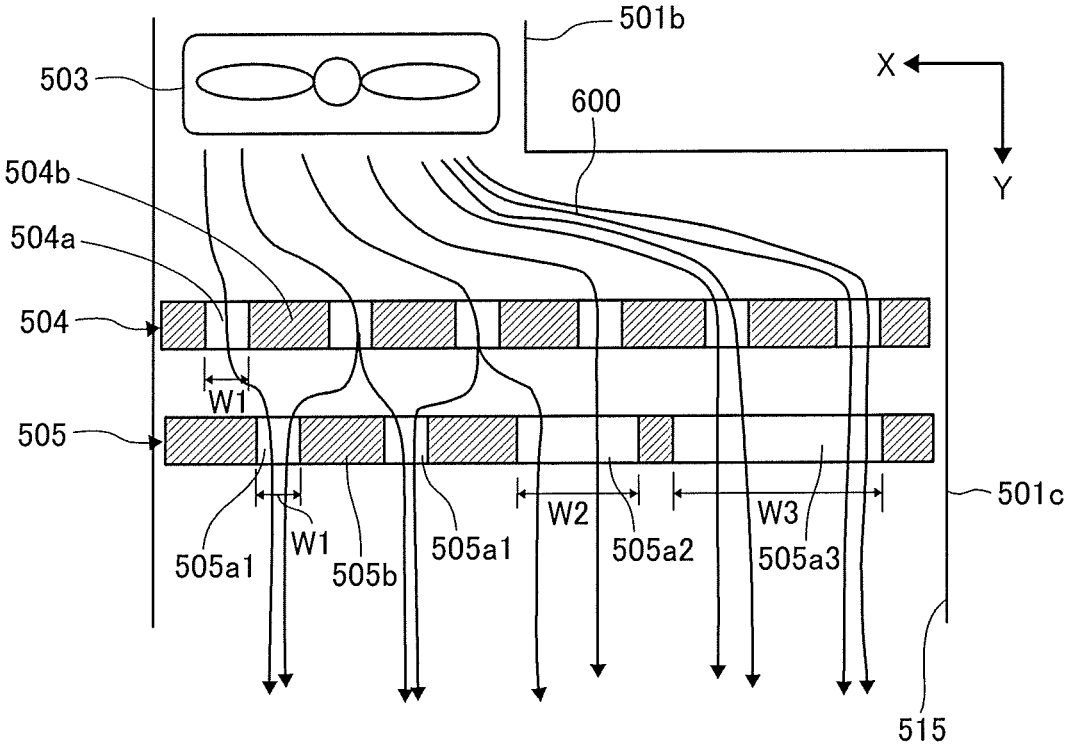
FIG. 24 is a cross-sectional plan view of a portion from an exhaust fan to an exhaust port according to a fifth embodiment of the present disclosure.

Next, a fifth embodiment of the present disclosure will be described with reference to FIG. 24. FIG. 24 is a cross-sectional plan view of the portion from the exhaust fan 503 to the exhaust port 515 in the same embodiment.

In the present embodiment, similarly to the fourth embodiment, the exhaust fan 503 is offset with respect to the first opening member 504 and the second opening member 505.

The first opening member 504 includes the first opening portion 504*a* having a width W1. In contrast, the second opening member 505 includes three types of second opening portions 505*a*1, 505*a*2, and 505*a*3 increasing their width from a width W1 to a width W3, respectively, as spaced away from the exhaust fan 503.

That is, the second opening member 505 includes; on the side relatively far from the exhaust fan 503, the second opening portions 505*a*2 and 505*a*3 having larger opening areas than the second opening portion 505*a*1 provided on the side closer to the exhaust fan 503. Additionally, the opening areas of the second opening portions 505*a*2 and 505*a*3 are larger than the opening area of the first opening portion 504*a* of the first opening member 504.

Furthermore, in the present embodiment, a part of the first opening portion 504*a* of the first opening member 504 on the upstream side is entirely opposed to the wall portion 505*b* of the second opening member 505 on the downstream side in the direction of the airflow 600, while the remaining part of the first opening portion 504*a* is opposed to the second opening portions 505*a*2 and 505*a*3 of the second opening member 505.

With the exhaust fan 503 being offset with respect to the second opening member 505 in this manner, the airflow 600 is guided by the second opening member 505 to meander to be exhausted from the exhaust port 515 even when the opening areas of the second opening portions 505*a*2 and 505*a*3 of the second opening member 505 away from the exhaust fan 503 are increased.

Moreover, with the opening areas of the second opening portions 505*a*2 and 505*a*3 of the second opening member 505 away from the exhaust fan 503 formed to be larger than the opening area of the second opening portion 505*a*1 closer to the fan, it is possible to promote the airflow 600 on the second opening portions 505*a*2 and 505*a*3 side.

Accordingly, by changing the opening areas (size) of the second opening portions, exhaust air volume is dispersed and exhausted throughout the exhaust port 515 as opposed to a general case where exhaust air volume is greater in a portion closer to the exhaust fan 503.

This configuration allows the airflow 600 including the exhaust mist is discharged in a wider range with slower flow velocity, leading to reduction of sticking of the mist to the outside of the apparatus.

Figure 25A:
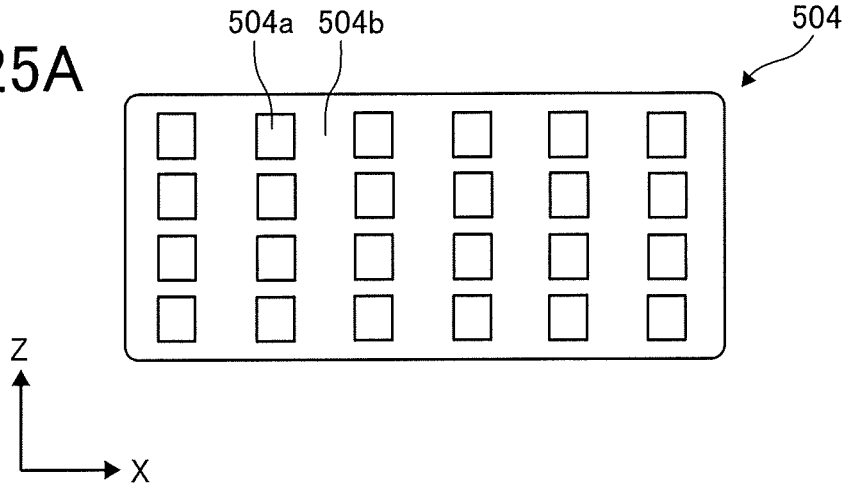
FIGS. 25A to 25C are front views illustrating a first opening member and a second opening member in a sixth embodiment of the present disclosure.
Figure 25B:
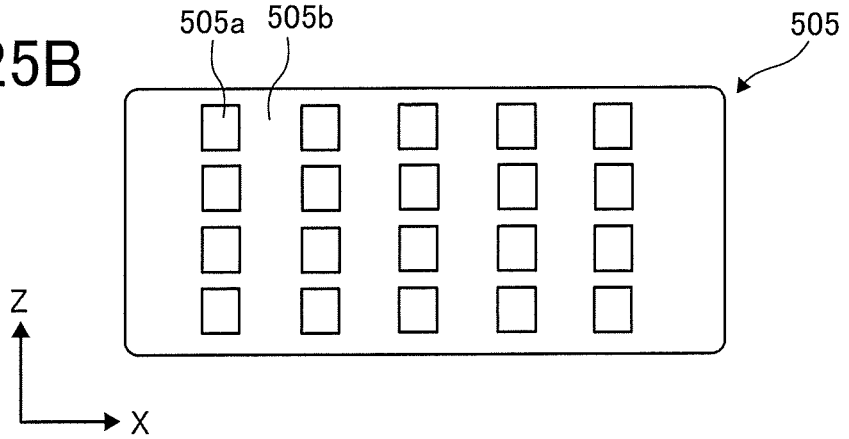
Figure 25C:
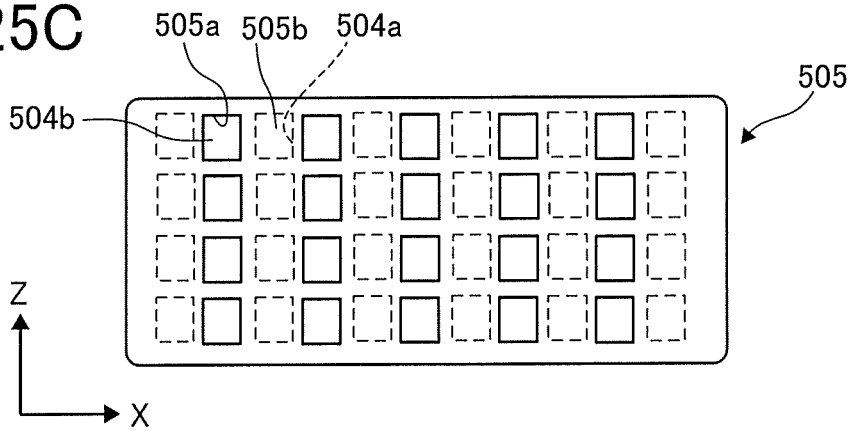
Figure 26:
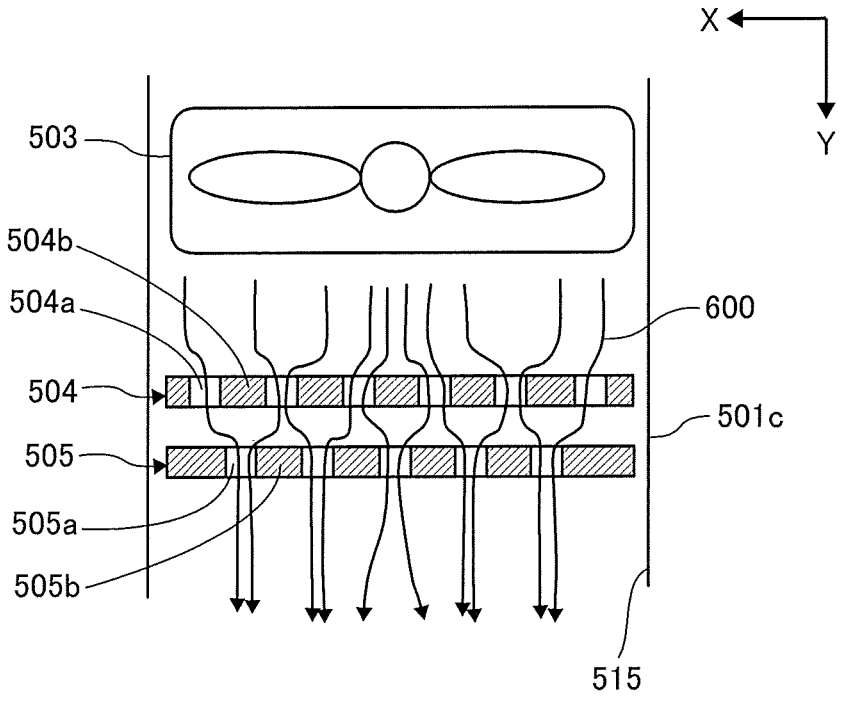
FIG. 26 is a cross-sectional plan view of a portion from the exhaust fan to the exhaust port of the sixth embodiment.

Next, a sixth embodiment of the present disclosure will be described with reference to FIGS. 25A to 25C and FIG. 26. FIGS. 25A to 25C are front views illustrating the first opening member 504 and the second opening member 505 in the same embodiment. Specifically, FIG. 25A is a front view of the first opening member 504, FIG. 25B is a front view of the second opening member 505, and FIG. 25C is a view as seen from the direction in which the first opening member 504 and the second opening member 505 overlap with each other. FIG. 26 is a cross-sectional plan view of a portion from the exhaust fan 503 to the exhaust port 515.

In the present embodiment, the width of the exhaust fan 503 in the X direction and the widths of the first opening member 504 and the second opening member 505 are substantially the same.

The first opening member 504 includes a plurality of first opening portions 504*a* arranged in a matrix, while portions other than the first opening portion 504*a* are provided as the wall portion 504*b*. Similarly, the second opening member 505 includes a plurality of second opening portions 505*a* arranged in a matrix, while the portion other than the second opening portion 505*a* is provided as the wall portion 505*b*.

Additionally as illustrated in FIGS. 25C and 26, the whole (or part of the first opening portion 504*a* of the first opening member 504) is opposed to the wall portion 505*b* of the second opening member 505.

With this configuration, similarly to the fourth embodiment, the airflow 600 exhausted from the exhaust fan 503 meanders and passes through the first opening portion 504*a* of the first opening member 504 and the second opening portion 505*a* of the second opening member 505, so as to be discharged from the exhaust port 515.

At this time, the first opening portion 504*a* of the first opening member 504 is arranged in a matrix to be opposed to the wall portion 505*b* of the second opening member 505. Accordingly, the airflow 600 is disturbed not only in the arrow X direction but also in the arrow Z direction, enabling the airflow 600 to generate more complicated flows than in the fourth embodiment.

This makes it possible to further reduce the mist discharged from the exhaust port 515.

Figure 27A:
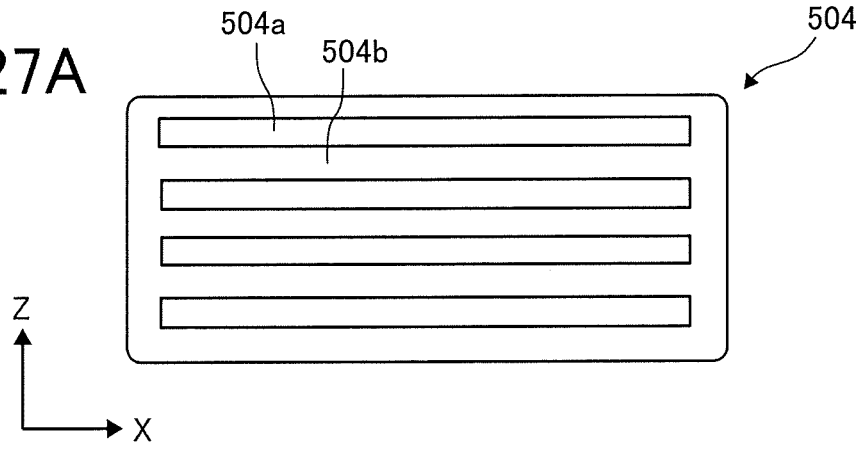
FIGS. 27A to 27C are front views illustrating a first opening member and a second opening member in a seventh embodiment of the present disclosure.
Figure 27B:
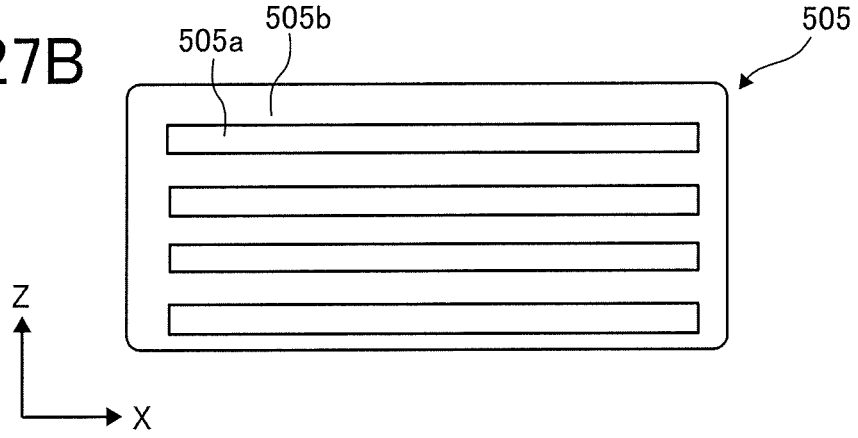
Figure 27C:
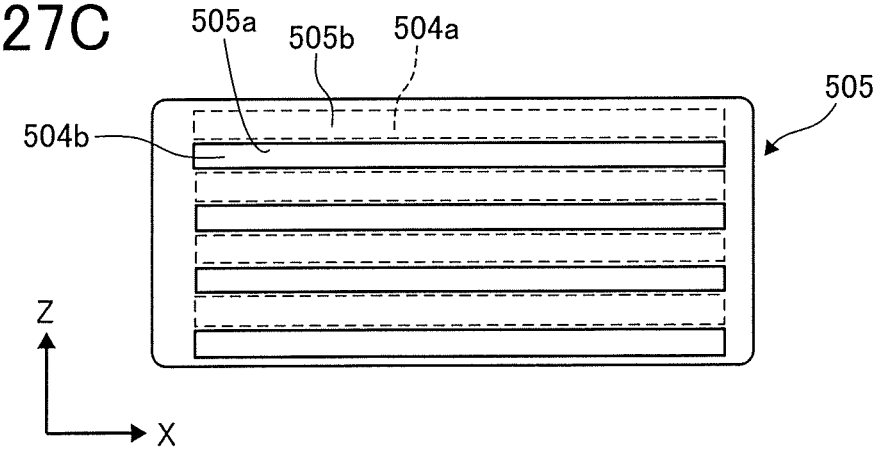

Next, a seventh embodiment of the present disclosure will be described with reference to FIGS. 27A to 27C. FIGS. 27A to 27C are front views illustrating the first opening member 504 and the second opening member 505 in the same embodiment. Specifically, FIG. 27A is a front view of the first opening member 504, FIG. 27B is a front view of the second opening member 505, and FIG. 27C is a view as seen from the direction in which the first opening member 504 and the second opening member 505 overlap with each other.

In the present embodiment, the plurality of slit-shaped first opening portions 504*a* of the first opening member 504 and the plurality of slit-shaped second opening portions 505*a* of the second opening member 505 are arranged side by side in the Z direction.

Even with such a configuration, the airflow 600 from the exhaust fan 503 meanders with disturbance, making it possible to reduce the mist discharged from the exhaust port 515, similarly to the sixth embodiment.

Figure 28:
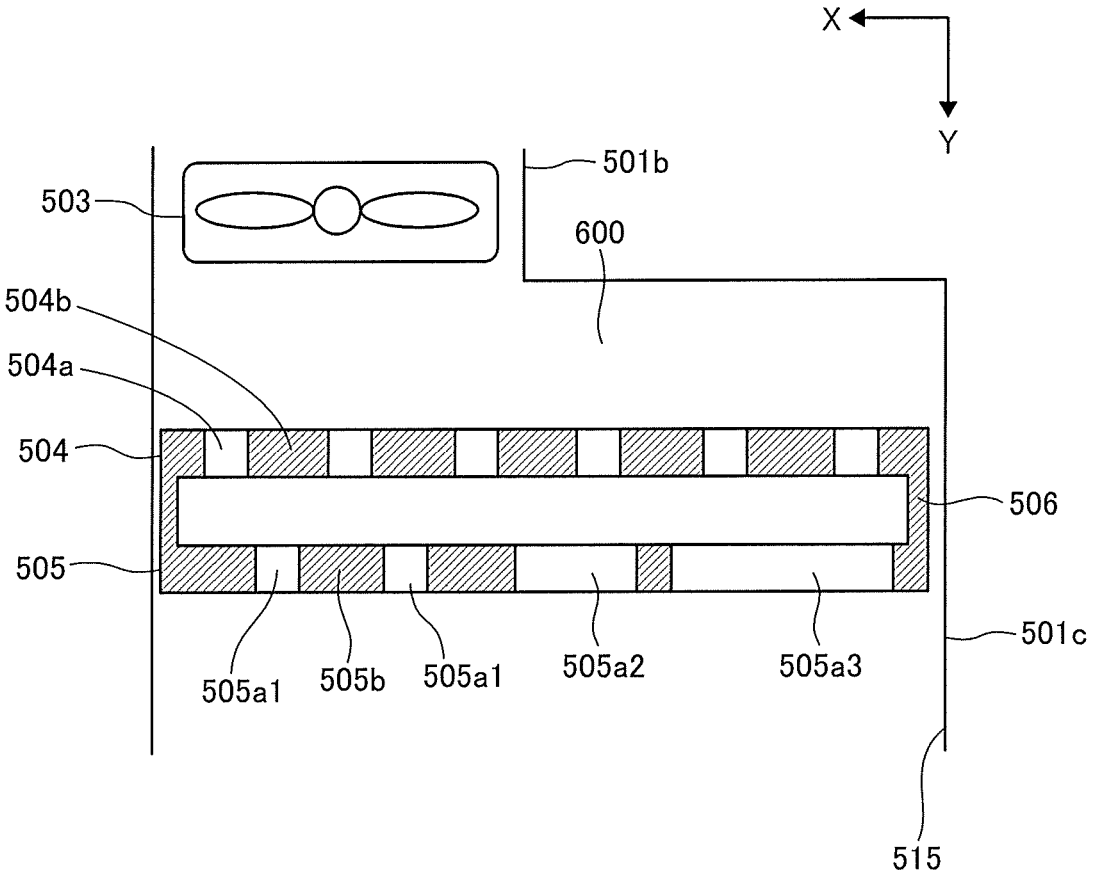
FIG. 28 is a cross-sectional plan view of a portion from an exhaust fan to an exhaust port in an eighth embodiment of the present disclosure.

Next, an eighth embodiment of the present disclosure will be described with reference to FIG. 28. FIG. 28 is a cross-sectional plan view of the portion from the exhaust fan 503 to the exhaust port 515 in the same embodiment.

In the present embodiment, the first opening member 504 and the second opening member 505 of the fifth embodiment are integrated by a bridging portion 506.

This configuration makes it possible to reduce the number of parts and facilitate assembly works.

Additionally, the first opening member 504 and the second opening member 505 can be integrated with the exhaust duct 501.

Figure 29A:
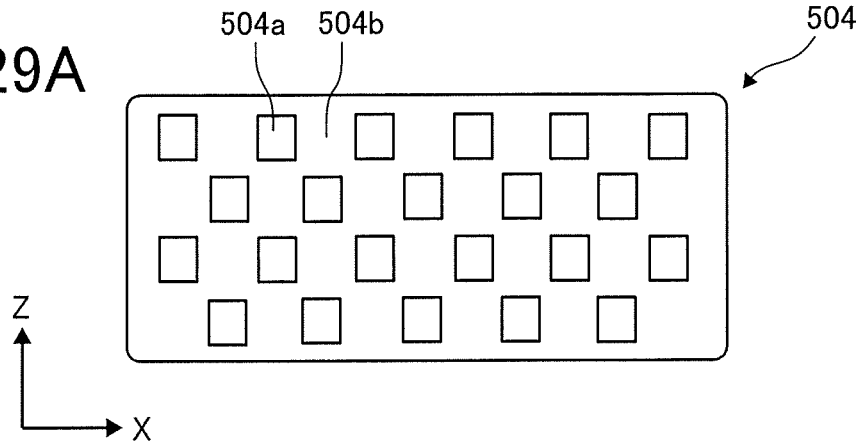
FIGS. 29A to 29C are front views of a first opening member and a second opening member according to a ninth embodiment of the present disclosure.
Figure 29B:
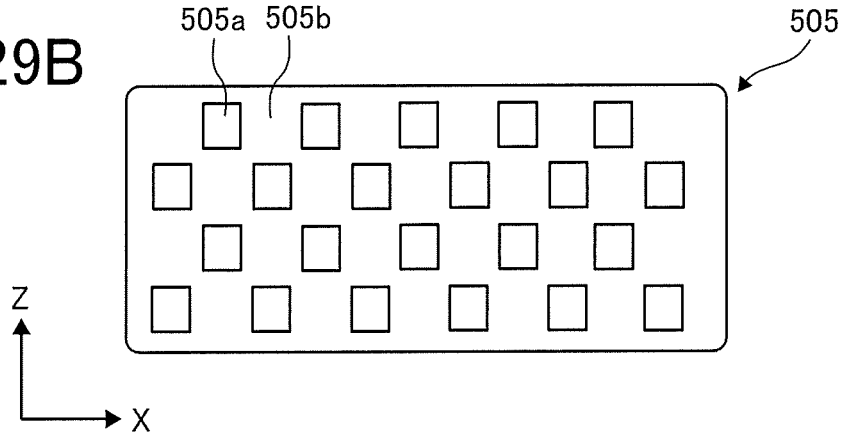
Figure 29C:
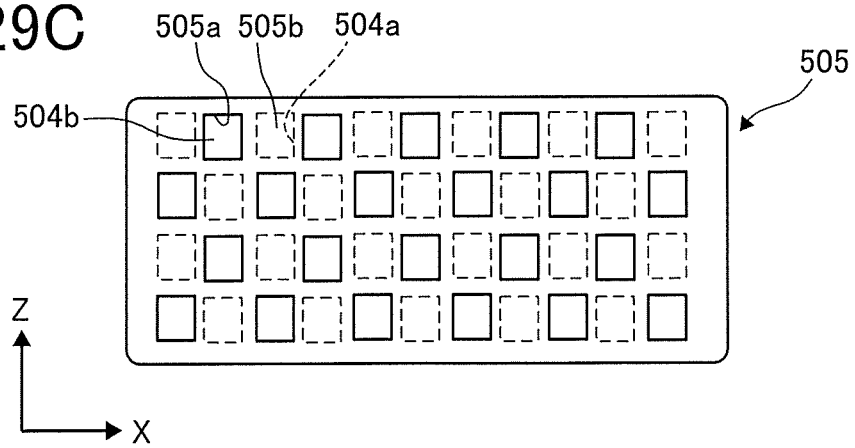

Next, a ninth embodiment of the present disclosure will be described with reference to FIGS. 29A to 29C. FIGS. 29A to 29C are front views illustrating the first opening member 504 and the second opening member 505 in the same embodiment. Specifically, FIG. 29A is a front view of the first opening member 504, FIG. 29B is a front view of the second opening member 505, and FIG. 29C is a view as seen from the direction in which the first opening member 504 and the second opening member 505 overlap with each other.

In the present embodiment, the first opening member 504 includes the plurality of first opening portions 504*a* arranged in a checker-pattern, while the portion other than the first opening portion 504*a* is provided as the wall portion 504*b*. Similarly, the second opening member 505 includes the plurality of second opening portions 505*a* arranged in a checker-pattern, while the portion other than the second opening portion 505*a* is provided as the wall portion 505*b*.

Additionally as illustrated in FIG. 29C, the whole (or part of) the first opening portion 504*a* of the first opening member 504) is opposed to the wall portion 505*b* of the second opening member 505.

With this manner, it is possible to generate a more complicated flow and further reduce the mist discharged from the exhaust port 515 similarly to the fifth embodiment.

Figure 30:
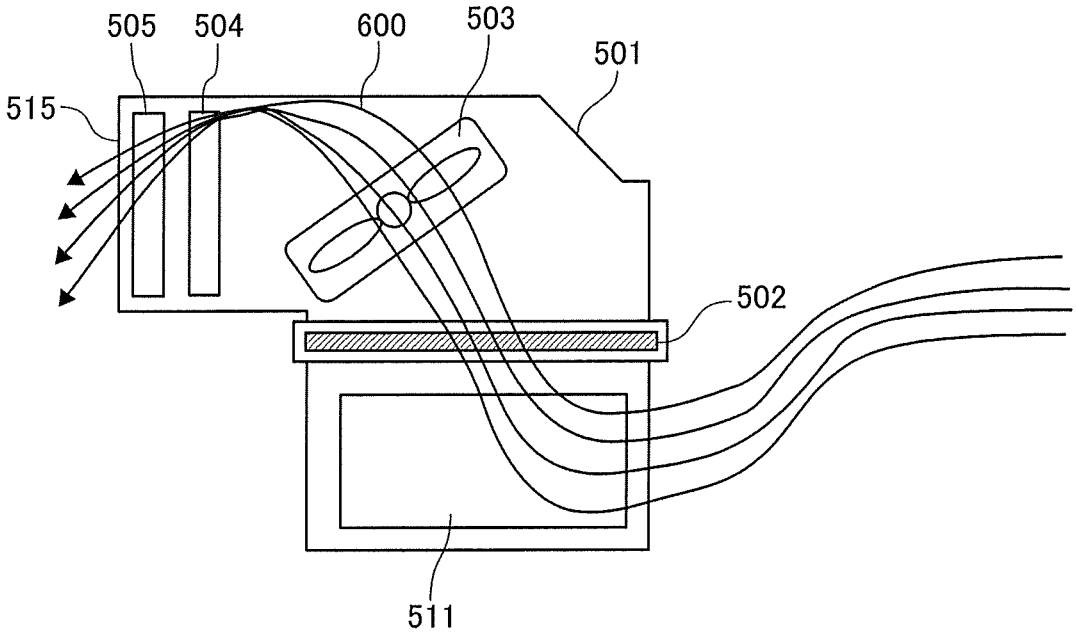
FIG. 30 is a side view of a mist collection device in a tenth embodiment of the present disclosure.

Next, a tenth embodiment of the present disclosure will be described with reference to FIG. 30. FIG. 30 is a side view of a mist collection device 500 in the same embodiment.

In the present embodiment, the exhaust fan 503 is disposed in a posture with the downstream side inclined to be diagonally facing upward so that an exhaust direction of the exhaust fan 503 is diagonal with respect to a direction in which the first opening member 504 and the second opening member 505 are arranged.

This configuration suppresses the airflow 600 discharged from the exhaust fan 503 from directly flowing to the first opening member 504 and the second opening member 505, making it possible to further disturb the airflow 600 and further reduce the mist discharged from the exhaust port 515.

Figure 31:
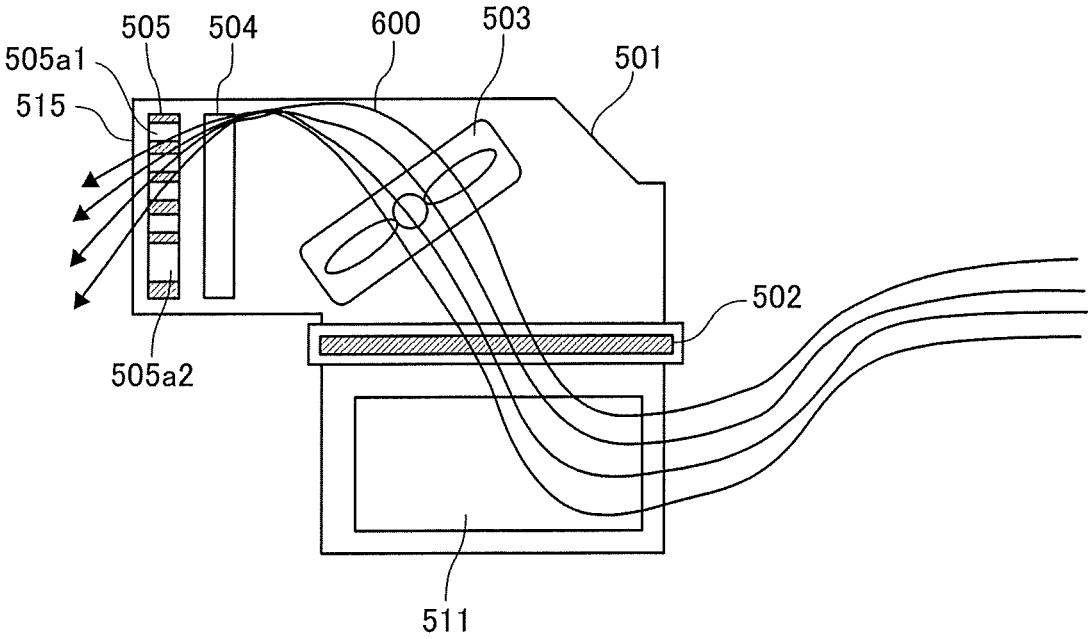
FIG. 31 is a side view of a mist collection device in an eleventh embodiment of the present disclosure.

Next, an eleventh embodiment of the present disclosure will be described with reference to FIG. 31. FIG. 31 is a side view of a mist collection device 500 in the same embodiment.

In the present embodiment, similarly to the ninth embodiment, the exhaust fan 503 is disposed in a posture with the downstream side inclined to be diagonally facing upward so that the exhaust direction of the fan is disposed diagonally with respect to the arrangement direction of the first opening member 504 and the second opening member 505.

In addition, the second opening member 505 used is a member having opening areas being varied in the vertical direction (Z direction). Here, the second opening portion 505*a* of the second opening member 505 forms the second opening portions 505*a*1 and 505*a*2 having opening areas increasing with the increase in the distance from the exhaust fan 503.

This configuration enables the airflow 600 to be dispersed throughout the exhaust port 515 and discharged similarly to the case of the fifth embodiment even when the exhaust fan 503 is disposed diagonally, so as to discharge the airflow 600 in a wider range at a lower flow rate, leading to reduction of sticking of the mist to the outside of the apparatus.

Figure 32:
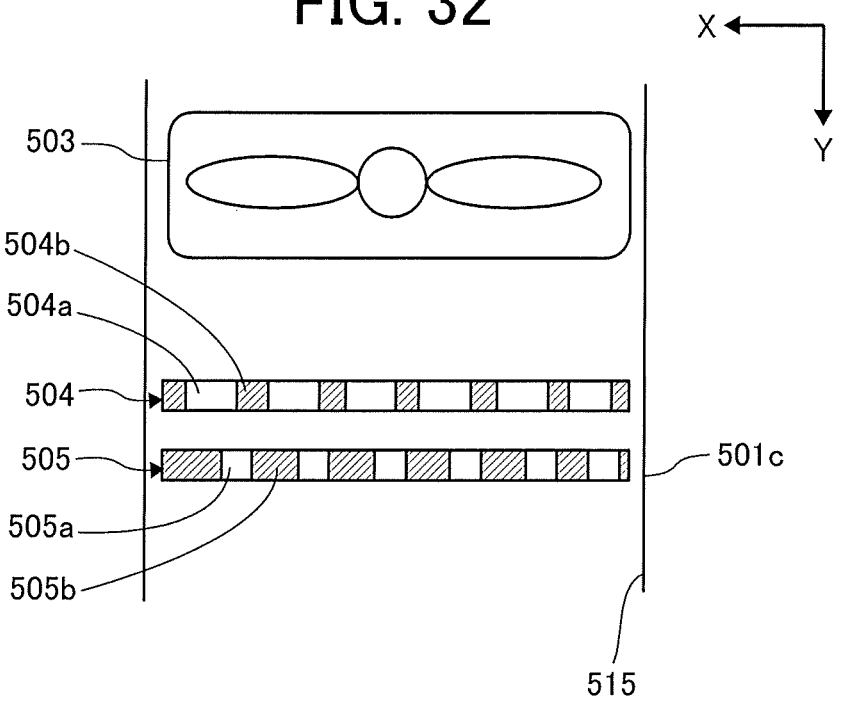
FIG. 32 is a cross-sectional plan view of a portion from an exhaust fan to an exhaust port in a twelfth embodiment of the present disclosure.

Next, a twelfth embodiment of the present disclosure will be described with reference to FIG. 32. FIG. 32 is a cross-sectional plan view of the portion from the exhaust fan 503 to the exhaust port 515 in the same embodiment.

In the present embodiment, the whole (or part of the) first opening portion 504*a* of the first opening member 504 being the opening member on the upstream side is opposed to a part of the wall portion 505*b* of the second opening member 505 being the opening member on the downstream side in the direction of the airflow 600.

Even with such a configuration, the airflow 600 can be disturbed to slow down the flow rate, making it possible to reduce the mist discharged from the exhaust port 515.

Figure 33:
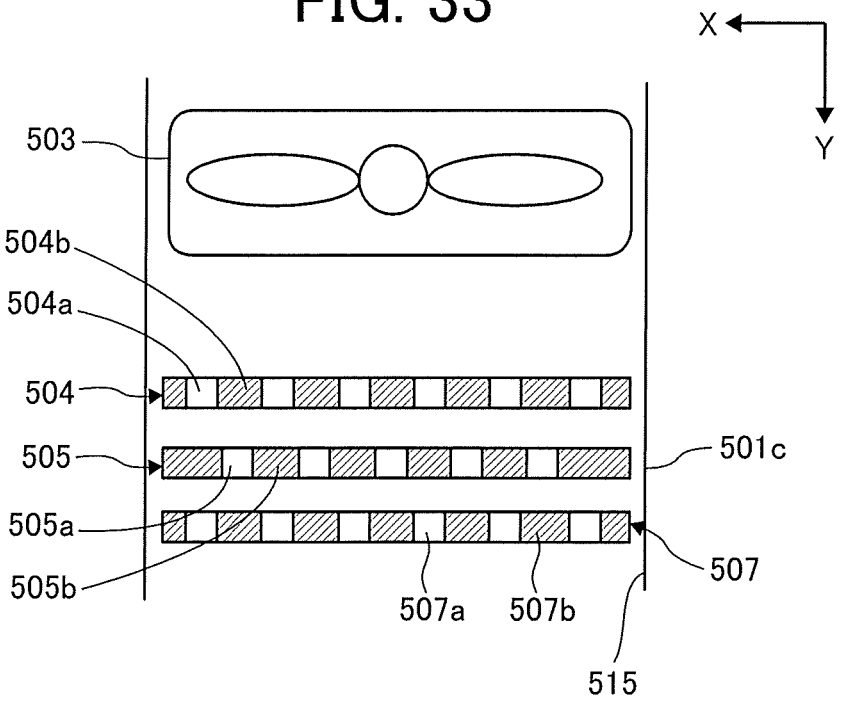
FIG. 33 is a cross-sectional plan view of a portion from an exhaust fan to an exhaust port in a thirteenth embodiment of the present disclosure.

Next, a thirteenth embodiment of the present disclosure will be described with reference to FIG. 33. FIG. 33 is a cross-sectional plan view of the portion from the exhaust fan 503 to the exhaust port 515 in the same embodiment.

In the present embodiment, three opening members, namely, the first opening member 504, the second opening member 505, and a third opening member 507, are arranged in this order. The third opening member 507 includes a third opening portion 507*a* and a wall portion 507*b*.

The opposing relationship between adjacent two opening members, namely, between the first opening portion 504*a* of the first opening member 504 and the wall portion 505*b* of the second opening member 505, and between the second opening portion 505*a* of the second opening member 505 and the wall portion 507*b* of the third opening member 507, can be set in similarly to the description in each of the above embodiments.

Disposing three or more opening members in this manner makes it possible to further reduce the mist discharged from the exhaust port 515.

In the present application, the liquid to be discharged may have any viscosity and surface tension that can be discharged from the head, and is not limited in particular. Still, it is preferable that the viscosity of the discharged liquid is 30 mPa·s or less at ordinary temperature and ordinary pressure or by heating and cooling. More specifically, the liquid may be, for example, a solvent such as water or an organic solvent, a colorant such as a dye or a pigment, or a solution containing a functionalizing material such as a polymerizable compound, a resin or a surfactant, a biocompatible material such as DNA, amino acid, protein, or calcium, or an edible material such as a natural pigment, suspension liquid, or emulsion. These liquids can be applied, for example, as an inkjet ink, a surface treatment liquid, formation liquid for constituents of an electronic element or a light-emitting element, or for an electronic circuit resist pattern, or as solution for three-dimensional modeling materials.

Examples of an energy generation source for liquid discharge include devices using a piezoelectric actuator (laminated type piezoelectric element and thin film type piezoelectric element), a thermal actuator using an electrothermal transducer such as a heating resistor, or an electrostatic actuator formed with a diaphragm and a counter electrode.

The "liquid discharge apparatus" includes an apparatus that is equipped with a liquid discharge head or a liquid discharge device and drives the liquid discharge head to eject a liquid. The liquid discharge apparatus includes not only an apparatus capable of discharging a liquid to a liquid stickable material but also an apparatus that discharges a liquid towards air or liquid.

The "liquid discharge apparatus" can include a unit related to feeding, conveying, sheet ejection of the liquid stickable material, a preprocessing apparatus, a post-processing apparatus, or the like.

Examples of the "liquid discharge apparatus" include an image forming apparatus which is an apparatus that discharges ink to form an image on a sheet, and a solid object modeling apparatus (three-dimensional modeling apparatus) that discharges a modeling liquid onto a powder layer formed with layers of powdery material in order to form a solid model (three-dimensional model).

The "liquid discharge apparatus" is not limited to an apparatus by which significant images such as letters, graphics, etc. are visualized by the discharged liquid. For example, an apparatus that forms a pattern or the like that has no meaning, and an apparatus that shapes a three-dimensional image are included.

The above "liquid stickable material" represents a material to which a liquid can be stuck at least temporarily, stuck and adhered, stuck and permeated, or the like. Specific examples include media such as recording media including a sheet, a recording sheet, recording paper, a film, a cloth, or an electronic substrate, electronic components such as piezoelectric elements, powdery material layer (powder layer), organ model, inspection cells. In short, the "liquid stickable material" includes all materials to which a liquid can stick unless specifically limited.

The above-mentioned "liquid stickable material" may be any material as long as a liquid can stick even temporarily, such as a sheet, thread, fiber, cloth, leather, metal, plastic, glass, wood, or ceramics.

In addition, there is a type of "liquid discharge apparatus" in which a liquid discharge head and a liquid stickable material move relative to each other, but embodiments of the present disclosure are not limited to this type. Specific examples include a serial type apparatus for moving the liquid discharge head, and a line type apparatus not moving the liquid discharge head.

Other examples of the "liquid discharge apparatus" include: a treatment liquid application apparatus that discharges a treatment liquid onto a sheet in order to apply the treatment liquid to the surface of the sheet for the purpose of modifying the surface of the sheet; and an injection granulation apparatus that injects a composition liquid in which raw materials are dispersed in a solution through a nozzle to granulate fine particles as a raw material.

In the terms of the present application, image formation, recording, printing, image printing, molding or the like are to be treated as synonymous.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A liquid discharge apparatus, comprising:
an apparatus body;
a holder to hold a target object;
a stage to reciprocate while holding the holder that holds the target object;
an exhaust fan to generate an airflow;
a suction port to suck the airflow generated by the exhaust fan; and
a partition partitioning an interior of the apparatus body into a space including the suction port and a space not including the suction port, wherein
the partition and the holder are arranged to form an airflow path toward the suction port between the partition and the holder.

2. The liquid discharge apparatus according to claim 1, wherein the exhaust fan is disposed at a position higher than the suction port.

3. The liquid discharge apparatus according to claim 1, further comprising a filter to capture mist,
wherein the filter is disposed on an upstream side of the exhaust fan in a direction of the airflow generated by the exhaust fan.

4. The liquid discharge apparatus according to claim 1, wherein the exhaust fan is disposed in a posture facing diagonally down toward an upstream side in a direction of the airflow generated by the exhaust fan.

5. The liquid discharge apparatus according to claim 1, wherein the target object is a cloth.

6. The liquid discharge apparatus according to claim 1, wherein the suction port is disposed on a side portion of the holder.

7. A liquid discharge apparatus comprising:
an apparatus body;
a holder to hold a target object;
a stage to reciprocate while holding the holder that holds the target object;
an exhaust fan to generate an airflow;
a suction port to suck the airflow generated by the exhaust fan;
a liquid discharge head to discharge a liquid onto the target object;
a carriage to hold the liquid discharge head; and
a gap former to form a spatial gap between the holder and the gap former, wherein
a lower surface of the gap former is being arranged at a position higher than a nozzle surface of the liquid discharge head.

8. The liquid discharge apparatus according to claim 6, wherein the lower surface of the gap former is arranged at a position lower than an upper surface of the carriage.

9. The liquid discharge apparatus according to claim 6, wherein the lower surface of the gap former is arranged at a position lower than an upper surface of the liquid discharge head.

10. The liquid discharge apparatus according to claim 7, wherein the exhaust fan is disposed at a position higher than the suction port.

11. The liquid discharge apparatus according to claim 7, further comprising a filter to capture mist,
wherein the filter is disposed on an upstream side of the exhaust fan in a direction of the airflow generated by the exhaust fan.

12. The liquid discharge apparatus according to claim 7, wherein the exhaust fan is disposed in a posture facing diagonally down toward an upstream side in a direction of the airflow generated by the exhaust fan.

13. The liquid discharge apparatus according to claim 7, wherein the target object is a cloth.

14. A mist collection device comprising:
an exhaust fan to generate an airflow; and
a plurality of opening members arranged on a downstream side of the exhaust fan in a direction of the airflow generated by the exhaust fan, wherein
each of the plurality of opening members including an opening portion and a wall portion, and
at least a part of the opening portion of one opening member on an upstream side in the direction of the airflow out of adjacent two of the plurality of opening members being opposed to at least a part of the wall portion of another opening member on the downstream side in the direction of the airflow out of the adjacent two of the plurality of opening members.

15. The mist collection device according to claim 14, wherein the opening portion of each of the plurality of opening members has a slit shape.

16. The mist collection device according to claim 14, wherein the exhaust fan is offset with respect to each of the plurality of opening members.

17. The mist collection device according to claim 13, wherein in at least one of the plurality of opening members, an opening area of the opening portion is larger on a first side than on a second side, and the first side is farther from the exhaust fan than the second side.

18. The mist collection device according to claim 14, wherein the plurality of opening members is integrated with each other.

19. The mist collection device according to claim 14, wherein an exhaust direction of the exhaust fan is diagonal with respect to a direction in which the plurality of opening members is arranged.

20. A liquid discharge apparatus comprising:

a liquid discharge device to discharge a liquid; and the mist collection device according to claim 14.

* * * * *